US007110009B2

(12) United States Patent
Ooishi et al.

(10) Patent No.: US 7,110,009 B2
(45) Date of Patent: Sep. 19, 2006

(54) DISPLAY CONTROL CIRCUIT AND DISPLAY DRIVING CIRCUIT

(75) Inventors: Yoshihisa Ooishi, Yokohama (JP); Hiroyuki Nitta, Fujisawa (JP); Junichi Maruyama, Yokohama (JP); Naoki Takada, Yokohama (JP); Kenichi Ono, Hitachi (JP)

(73) Assignee: Renesas Technology Corp., Tokyo (JP)

( * ) Notice: Subject to any disclaimer, the term of this patent is extended or adjusted under 35 U.S.C. 154(b) by 294 days.

(21) Appl. No.: 10/845,076

(22) Filed: May 14, 2004

(65) Prior Publication Data

US 2004/0263540 A1 Dec. 30, 2004

(30) Foreign Application Priority Data

May 15, 2003 (JP) ..... 2003-137862

(51) Int. Cl.
*G09G 5/10* (2006.01)
*G09G 3/36* (2006.01)

(52) U.S. Cl. ..... 345/690; 345/89; 345/90; 345/95

(58) Field of Classification Search ..... 345/89–100, 345/204–212, 690; 315/169.1–169.4
See application file for complete search history.

(56) References Cited

U.S. PATENT DOCUMENTS

| | | | | |
|---|---|---|---|---|
| 6,879,310 | B1 * | 4/2005 | Nose | 345/88 |
| 6,903,716 | B1 * | 6/2005 | Kawabe et al. | 345/99 |
| 6,995,758 | B1 * | 2/2006 | Fukuda | 345/205 |
| 7,030,869 | B1 * | 4/2006 | Morita | 345/208 |

FOREIGN PATENT DOCUMENTS

| | | |
|---|---|---|
| JP | 5-80722 | 4/1993 |
| WO | WO 99/63513 | 12/1999 |

* cited by examiner

*Primary Examiner*—Vijay Shankar
(74) *Attorney, Agent, or Firm*—Antonelli, Terry, Stout and Kraus, LLP.

(57) ABSTRACT

A display control circuit divides M display data for M pixels assigned to each of plural display driving circuits among display data received in an order of an arrangement of pixels in a row, into plural display data sets each composed of N display data, rearranges the plural display data sets such that one of the plural display data sets assigned to one of the plural display driving circuits is followed by one of the plural display data sets assigned to another of the plural display driving circuits succeeding the one of the plural display driving circuits, and outputs the rearranged display data sets to the plural display driving circuits.

24 Claims, 13 Drawing Sheets

DISPLAY CONTROL CIRCUIT AND DISPLAY DRIVING CIRCUIT

CLAIM OF PRIORITY

The present application claims priority from Japanese application serial no. 2003-137862, filed on May 15, 2003, the content of which is hereby incorporated by reference into this application.

BACKGROUND OF THE INVENTION

The present invention relates to a data line driving circuit which generates gray-scale voltages corresponding to display data, and applies the gray-scale voltages to a display panel; and to a display control circuit which outputs display data and control signals (sync signals, clock signals, and the-like) to a data line driving circuit.

More particularly, the present invention relates to a data line driving circuit and a display control circuit for a liquid crystal display, an organic EL (electroluminescent) display, a plasma display, a field emission display, and the like.

As a conventional technique, International Publication No. W099/63513 (Published Japanese Translation of PCT international publication for Patent Application No. 2002-517790) discloses a display driving system. This system comprises: a serial-to-parallel converter for rearranging segments of serially supplied digital pixel data into parallel pixel data; six digital-to-analog (D/A) converters for converting parallel pixel data of two pixels at a time into analog red, green and blue signals; plural column drivers each including an analog sample-and-hold module which samples six analog signals at the same time; and a timing controller for supplying an entire row of digital pixel data to the plural column drivers at the same time.

Further, Japanese Patent Application Laid-Open No. Hei 5-80722 publication discloses a liquid crystal display device. This liquid crystal display device has M multi-gray-scale driving circuits. The M multi-gray-scale driving circuits are each assigned to respective ones of M groups of pixel sections into which pixels contained in one horizontal row among pixels arranged in a matrix fashion are divided, and each apply display data to pixel sections of corresponding ones of the M groups in one horizontal row (M is an integer). The M multi-gray-scale driving circuits are arranged in a horizontal direction, and each of them includes a latch circuit, a digital-to-analog (D/A) converter, and a sample-and-hold circuit. The latch circuit sequentially takes in and temporarily stores digital display data for pixels corresponding to a horizontal pixel row divided by (M×N), obtained by subdividing the display data of each of the M groups of pixel sections into N groups (N is an integer). Every time when the digital display data for pixels corresponding to a horizontal pixel row divided by (M×N) is entered, the digital-to-analog (D/A) converter converts the digital display data into analog display data. The sample-and-hold circuit takes in the analog display data for pixels corresponding to the horizontal pixel row divided by M. After all the M multi-gray-scale driving circuits have taken in their corresponding analog display data for pixels corresponding to the horizontal pixel row divided by M, they apply the analog display data for the entire horizontal pixel row to the pixel sections at the same time.

In the above conventional technique, one multi-gray-scale driving circuit (column driver) employs a D/A converter whose capacity is smaller than that required for the analog display data simultaneously applied to the display pixel sections by that circuit (column driver), i.e., the number of D/A converters is smaller, and therefore the multi-gray-scale driving circuit (column driver) can be made compact.

SUMMARY OF THE INVENTION

In both the above conventional techniques, however, digital display data are continuously transferred from a timing controller to one multi-gray-scale driving circuit (column driver). More specifically, first a first set of display data is transferred to a first multi-gray-scale driving circuit and then after all the desired display data have been transferred to the first multi-gray-scale driving circuit, a second set of display data is transferred to a second multi-gray-scale driving circuit. This means that if the number of display data bits for one pixel is increased from eight to ten, for example, the capacity of the D/A converters will not be sufficient. To compensate for the insufficient capacity of the D/A converters, the need arises to increase the number of D/A converters, resulting in increase in size of the multi-gray-scale driving circuits.

An object of the present invention is to provide a display driving circuit made compact by reducing internal circuit elements, and a display control circuit for realizing such a display driving circuit.

In an embodiment of the present invention, a display control circuit (for example, a timing control circuit) receives display data in an order of an arrangement of a plurality of pixels in one of pixel rows in a display panel; divides M (an integer, 1<M< the number of pixels contained in one pixel row, and M=6, for example) display data for M pixels of the plurality of pixels assigned to each of a plurality of display driving circuits (for example, data line driving circuits), into a plurality of display data sets each comprised of N (an integer, 1≦N< M, and N=2, for example) display data, rearranges the plurality of display data sets such that one of the plurality of display data sets assigned to one of the plurality of display driving circuits is followed by one of the plurality of display data sets assigned to another of the plurality of display driving circuits succeeding the one of the plurality of display driving circuits; and outputs the rearranged plurality of display data sets to the plurality of display driving circuits. One of the plurality of display driving circuits outputs an enable signal to another of the plurality of display driving circuits at a time when the one of the plurality of display driving circuit has received N display data corresponding to N pixels of the M pixels. With this, the display control circuit outputs the corresponding display data sets at different times to each of the plurality of display driving circuits during intervals (horizontal scanning periods) in which the plurality of display driving circuits apply all gray scale voltages associated with another of the pixel rows simultaneously to the display panel. That is to say, a first one of the plurality of display driving circuits is supplied with display data of a first display data set (display data for N pixels) which are smaller in number than display data of a first display data group (a display data group for M pixels) which correspond to a first group of gray scale voltages to be applied to the display panel simultaneously by the first one of the plurality of display driving circuits, and thereafter a second one of the plurality of display driving circuits is supplied with display data of a second display data set (display data for N pixels) which are smaller in number than display data of a second display data group (a display data group for M pixels) which correspond to a second group of gray scale voltages to be applied to the display panel simultaneously by the second one of the plurality of display driving circuits.

In another embodiment of the present invention, in a case where each of the plural display driving circuits is provided with a plurality of converter circuits (for example, D/A converters), a display control circuit receives display data in an order of an arrangement of pixels in one of pixel rows in a display panel, divides X (for example, X=3) display data for X pixels assigned to each of the plurality of converter circuits, into a plurality of display data sets each comprised of Y (for example, Y=1) display data, where 1<X< the number M (for example, M=6) of pixels assigned to each of the plural display driving circuits, X is an integer, 1<Y< X, and Y is an integer, rearranges the plural display data sets such that one of the plural display data sets assigned to one of the plural converter circuits is followed by one of the plural display data sets assigned to a succeeding one of the plural converter circuits, and then outputs the rearranged plural display data sets to each of the plural display driving circuits in the rearranged order. That is to say, while the previous embodiment performs the rearrangement of display data involving plural display driving circuits, this embodiment performs the rearrangement of display data involving plural converter circuits within the same display driving circuit. Of course, these two embodiments may be combined.

In yet another embodiment of the present invention, a display circuit is provided with reference voltage generating circuits which generate reference voltages for red, green and blue display signals, respectively and separately, and a register which serves to establish γ characteristics in the reference voltage generating circuits for red, green and blue display signals, respectively, and converter circuits for red, green and blue in common which generate a plurality of gray scale voltages based on the reference voltages, select analog gray scale voltages from among the plurality of gray scale voltages based on digital display data for red, green and blue, respectively, and output the selected analog gray scale voltages. That is to say, γ characteristics can be adjusted for red, green and blue, respectively and separately.

BRIEF DESCRIPTION OF THE DRAWINGS

FIG. 1(A) is a diagram showing a circuit configuration of the first embodiment, and FIG. 1(B) is a diagram showing a relationship in data arrangement between display data 102 and display data 108;

FIG. 7(A) is a diagram showing a circuit configuration of the second embodiment, and FIG. 7(B) is a diagram showing a relationship in data arrangement between display data 102 and display data 108;

FIG. 13(A) is a diagram showing transfer timing in the output circuit 121 of FIG. 11, and FIG. 13(B) is a diagram showing transfer timing in the output circuit 121 of FIG. 12.

DETAILED DESCRIPTION OF THE PREFERRED EMBODIMENTS

A first embodiment of the present invention will be explained below using FIGS. 1(A) to 6.

Figure 1A:
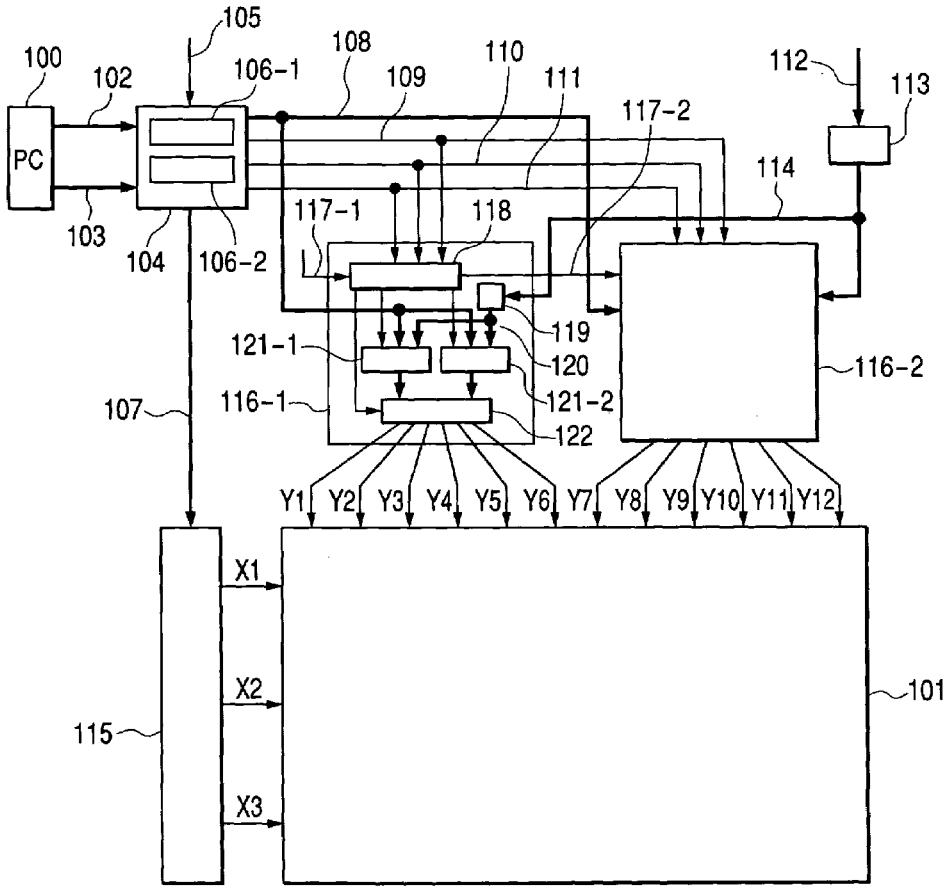
FIGS. 1(A) and 1(B) are diagrams showing a first embodiment of the present invention.

FIG. 1(A) is a diagram showing the circuit configuration of the present invention, assuming that a liquid crystal display system has a resolution capability of 12×3 pixels, and produces 1024 gray scale levels by using 10 bits per pixel.

Reference numeral 100 denotes an external system (for example, a personal computer), and reference numeral 101 denotes a liquid crystal display panel which has a plurality of pixels arranged in a 12-by-3 pixel matrix form with twelve columns Y1 to Y12 extending in a column direction (a data arrangement direction) and three rows X1 to X3 extending in a row direction (a horizontal scanning direction). Reference numerals 102 and 103 denote display data and control signals, respectively, that are input from an external system 100, and it is assumed that the display data 102 are each composed of eight or ten bits per pixel. Reference numeral 104 denotes a timing control circuit (TCON) that outputs display data and control signals, and reference numeral 105 denotes a setup signal for the timing control circuit 104. The timing control circuit 104 has therein line memories 106-1 and 106-2 for storing display data for plural lines (for example, two lines). Each of the line memories 106-1 and 106-2 has storage capacity for storing display data for one pixel row, and a combination of the line memories 106-1 and 106-2 has storage capacity for one pixel row Reference numeral 107 denotes a scan line driving circuit control signal that determines timing of voltage application in a row direction on the liquid-crystal display panel 101. Reference numeral 108 denotes 10-bit-per-pixel display data obtained by rearranging (changing the order of arrangement of) display data in the timing control circuit 104 during one horizontal scanning period (i.e., during time intervals at which one of data line driving circuits 116-1 and 116-2 applies gray-scale voltages corresponding to one entire pixel row simultaneously to pixels of the liquid crystal display panel 101). Reference numeral 109 denotes a sync clock for display data, reference numeral 110 an ac driving control signal that controls polarity of gray-scale voltages applied to the liquid-crystal display panel 101, and reference numeral 111 denotes an output signal that establishes output timing of the gray-scale voltages to be applied to the liquid-crystal display panel 101. Reference numeral 112 denotes a reference voltage input from outside, and this reference voltage is composed of two levels. Reference numeral 113 denotes a gray-scale reference voltage generator, and reference numeral 114 denotes gray-scale reference voltages. The gray-scale reference voltage generator 113 divides the reference voltage and generates the gray-scale reference voltages 114 of 18 levels. Reference numeral 115 denotes a scan line driving circuit that determines a voltage to be applied to a scan line on the basis of the scan line driving circuit control signal 107, and reference numerals 116-1 and 116-2 denote data line driving circuits. The two driving circuits both have an internal circuit configuration performing the same function, in which the data line driving circuits 116-1 and 116-2 output gray-scale voltages corresponding to display data, to the data lines Y1 to Y6 and data lines Y7 to Y12, respectively, of the liquid crystal display panel 101. The number of data line driving circuits 116 is preferably three or more. In the present embodiment, however, the number is two for the sake of convenience in explanation. Reference numeral 117-1 denotes an input-enabling signal for the data line driving circuit 116-1, and reference numeral 117-2 denotes an input-enabling signal for the data line driving circuit 116-2. The input-enabling signal 117-1 is always at a high level, and the input-enabling signal 117-2 is output from the data line driving circuit 116-1. The data line driving circuits 116-1 and 116-2 each start to take in display data on the basis of the display data 108, the output signal 111, the input-enabling signals 117-1 and 117-2. Reference numeral 118 denotes a timing regulator present in each of the data line driving circuits 116. Reference numeral 119 denotes a voltage divider that divides the gray-scale reference voltage 114 and generates gray-scale voltages of 2048 levels in all, one being of 1024 levels of positive polarity and the other being of 1024 levels of negative polarity, and reference numeral 120 denotes gray-scale voltages obtained by the voltage division. Reference numerals 121-1 and 121-2 denote conversion blocks that convert digital data into analog data by selecting a voltage from among the gray-scale voltages 120 on the basis of the display data 108 and the ac driving control signal 110, and the conversion blocks 121-1 and 121-2 both have an identical function. Reference numeral 122 denotes an output circuit that outputs analog data (gray-scale voltages) to the liquid-crystal display panel 101. One line memory 106 for one pixel row may be used in place of two line memories 106-1 and 106-2.

Figure 1B:
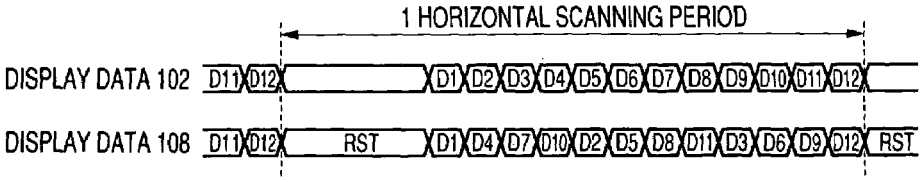

FIG. 1(B) is a diagram showing a relationship of data rearrangement between the display data 102 and display data 108 shown in FIG. 1(A). In FIG. 1(B), D1, D2, . . . , D12 denote 8-bit or 10-bit display data associated with column terminals Y1, Y2, . . . , Y12, respectively, of the liquid crystal display panel 101. The timing control circuit 104 changes the order of arrangement of the display data 102 which was received in the order of D1, D2, . . . , D12 (i.e., in the order of pixels arranged in the horizontal direction of the liquid crystal display panel 101), to the order of D1, D4, D7, D10, . . . , D12, and outputs the rearranged data as the display data 108.

Incidentally, when a single conversion block 121 is employed in each of the data line driving circuits 116, the order of arrangement of the display data 108 may be changed to the order of D1, D7, D4, D10, D2, D8, D5, D11, D3, D9, D6, and D12. That is to say, in this case, the timing control circuit 104 outputs the display data 108 to the data line driving circuits 116-1 and 116-2 alternately. When a number N of data line driving circuits 116 are employed, D1 may be output to the first data line driving circuit 116-1, D7 may be output to the second data line driving circuit 116-2, D13 may be output to the third data line driving circuit 116-3, . . . , D(6N-5) to the Nth data line driving circuit 116-N.

Reference characters D1 to D6 here denote the a group of display data that the data line driving circuit 116-1 outputs to the liquid crystal display panel 101 during one horizontal scanning period, i.e., a group of display data that are output to the liquid crystal display panel 101 at the same time (collectively).

Figure 2:
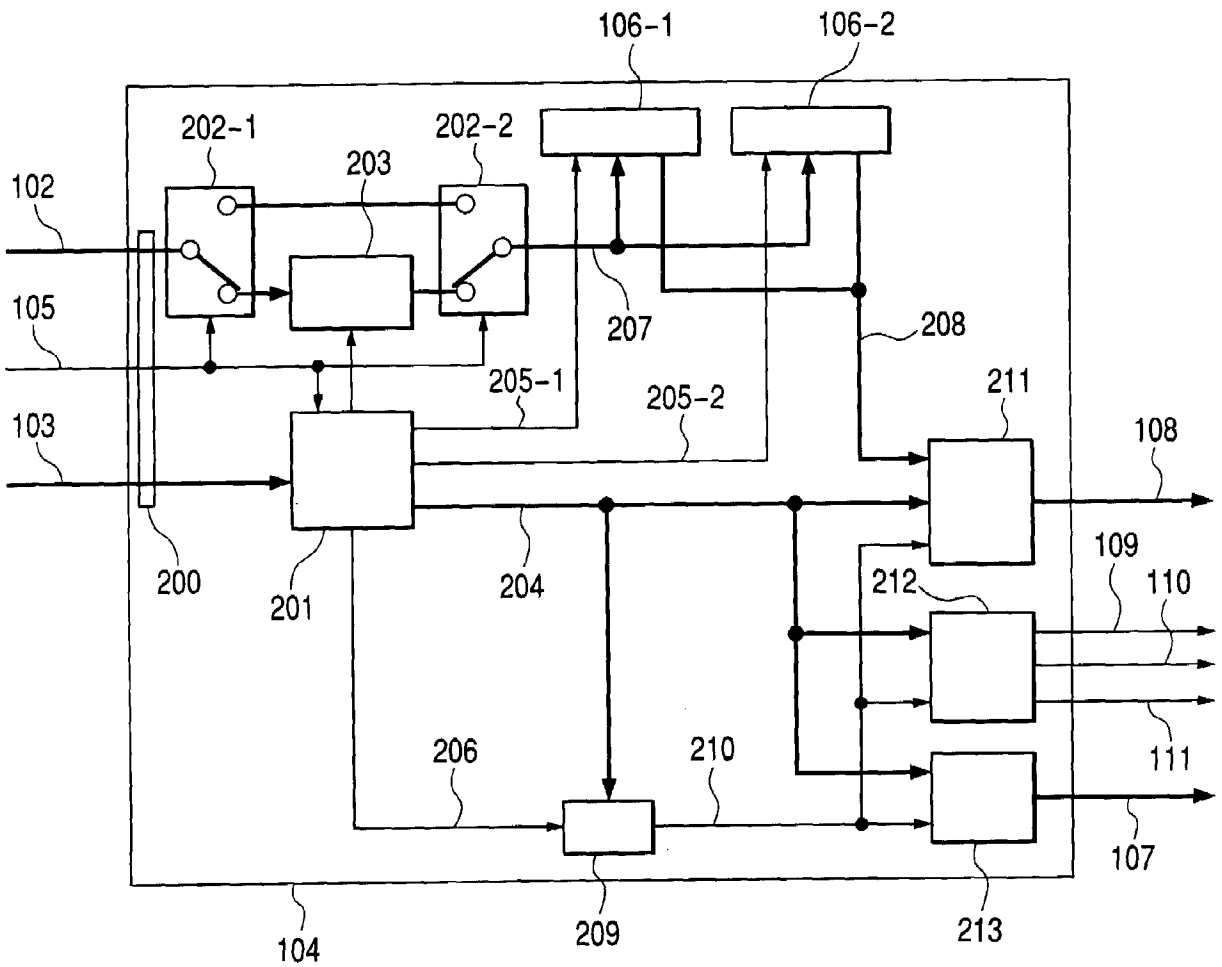
FIG. 2 is a diagram showing a configuration of a timing control circuit 104.

FIG. 2 is a diagram showing a detailed configuration of the timing control circuit 104. Reference numeral 200 denotes an interface for receiving the display data 102, the control signal 103, and the setup signal 105 from the external system (PC) 100, and reference numeral 201 denotes a timing regulator. Reference numerals 202-1 and 202-2 denote bit-number selectors for display data, and reference numeral 203 denotes a look-up table for converting the number of bits in data. On the basis of the control signal 103 and the setup signal 105, the timing regulator 201 generates a timing signal 204 that functions as a reference for operation within the timing control circuit 104, memory control signals 205-1 and 205-2 that establish memory access timing, and an internal reference clock 206. Reference numeral 207 denotes 10-bit display data.

When the display data 102 input from the external system 100 (see FIG. 1) are of the 8-bit-per-pixel type, the bit-number selectors 202-1, 202-2 select a system provided with the look-up table 203, and thereby the 8-bit display data are converted into 10-bit display data. On the other hand, the display data 102 are of the 10-bit-per-pixel type, the bit-number selectors 202-1, 202-2 select a system not provided with the look-up table 203, the display data bypass the look-up table. The display data 207 of the ten-bit-per-pixel from the bit-number selectors 202-1, 202-2 are written into the line memories 106-1, 106-2 on the basis of the memory control signals 205-1, 205-2. Reference numeral 208 denotes display data read out from the line memories 106-1, 106-2. Reference numeral 209 denotes a phase-locked loop (PLL) circuit, which multiplies the internal reference clock 206 in steps and thereby generates a reference clock 210. Reference numeral 211 denotes a display data timing regulator, which generates the display data 108 on the basis of the timing signal 204, the display data 208, and the reference clock 210. Reference numeral 212 denotes a data line driving circuit timing regulator, which generates, on the basis of the timing signal 204 and the reference clock 210, the sync clock 109 required for operation of the data line driving circuits 116-1, 116-2, the ac driving control signal 110 and the output signal 111. Reference numeral 213 denotes a scan line driving circuit timing regulator, which generates, on the basis of the timing signal 204 and the reference clock 210, the scan line driving control signal 107 required for operation of the scan line driving circuit 115.

Figure 3:
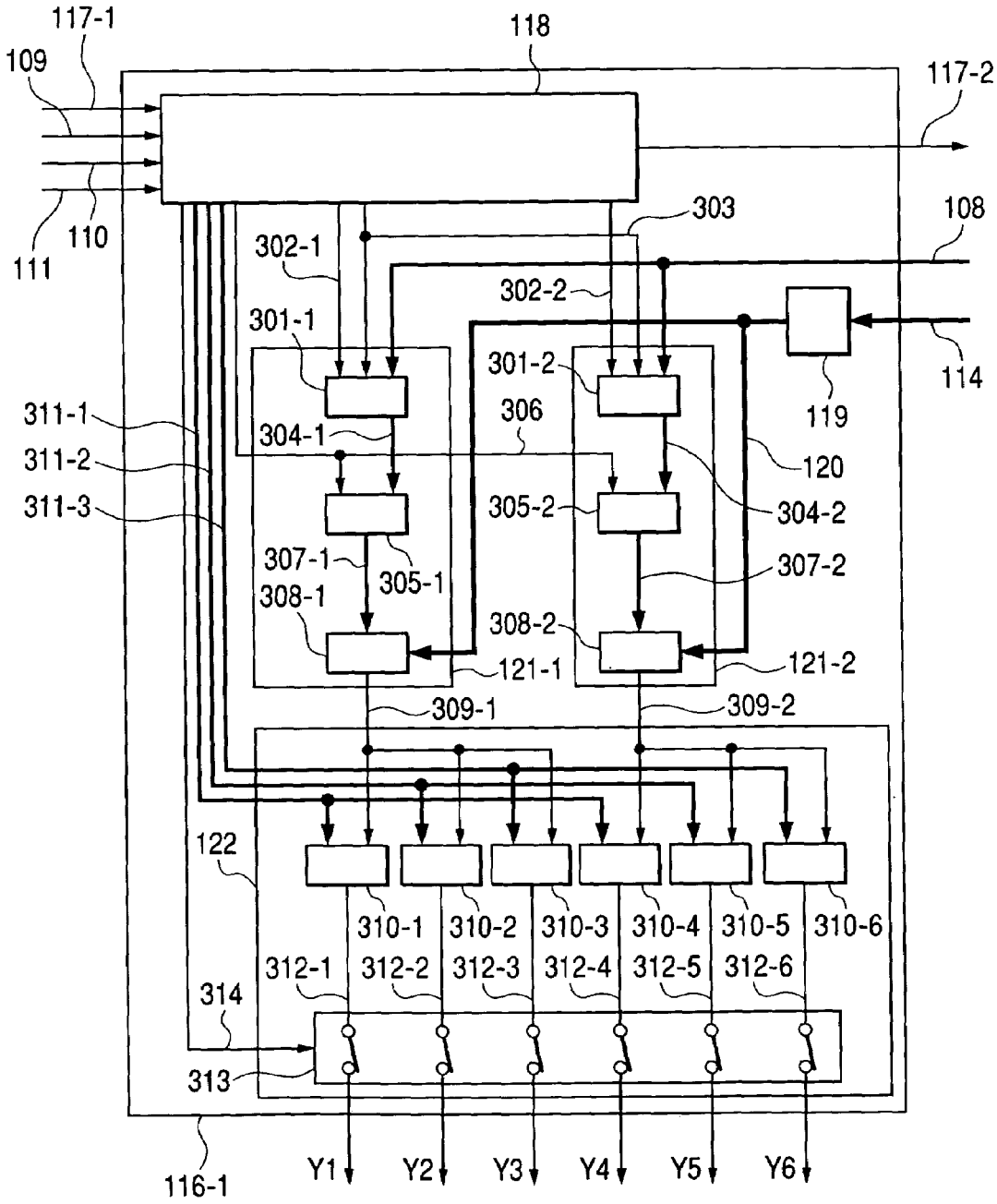
FIG. 3 is a diagram showing a configuration of a data line driving circuit 116-1.

FIG. 3 is a diagram showing a detailed configuration of the data line driving circuit 116-1. The blocks having functions equivalent to those of FIGS. 1(A) and 1(B) are assigned the same reference numerals. Reference numerals 301-*i* (i=1, 2) denote first latch circuits, reference numerals 302-*i* (i=1, 2) are first latch signals, reference numeral 303 is an AC driving control signal that determines polarity of gray-scale voltages, and reference numeral 304-I (i=1, 2) are display data. The first latch circuits 301-I latch the 10-bit display data 108 and the ac driving control signal 303 based upon the first latch signals 302-*i* and generate 11-bit display data 304-*i*. Reference numeral 305-*i* denote second latch circuits, reference numeral 306 is a second latch signal, and reference numeral 307-I are display data. The second latch circuits 305-*i* latch the display data 304-*i* based upon the second latch signal 306 and produce display data 307-*i*. Reference numeral 308-*i* denote D/A converters, and reference numeral 309-*i* denote output voltages. The D/A converter 308-*i* select, on the basis of the display data 307-*i*, one voltage from among the 2048 gray-scale voltage levels that were generated by the voltage divider 119 by dividing the gray scale reference voltages 114 of 18 levels, and outputs the selected voltage level as output voltages 309-*i*. The first latch circuit 301-1, the second latch circuit 305-1, and the D/A converter 308-1 in FIG. 3 constitute the conversion block 121-1 shown in FIG. 1(A), and similarly, the first latch circuit 301-2, the second latch circuit 305-2, and the D/A converter 308-2 in FIG. 3 constitute the conversion block 121-2.

Reference numeral 310-*j* (j=1 to 6) denote sample-and-hold circuits, reference numeral 311-*k* (k=1, 2, 3) are control signal groups for sample-and-hold circuits 310-*j*, reference numeral 312-*j* are output voltages that are output from sample-and-hold circuits 310-*j*. As shown in FIG. 3, the control signal group 311-1 is input to the sample-and-hold circuits 310-1 and 310-4, the control signal group 311-2 is input to the sample-and-hold circuits 310-2 and 310-5, and the control signal group 311-3 is input to the sample-and-hold circuits 310-3 and 310-6. Each of the sample-and-hold circuits 310-*j* samples and holds the output voltages 309-1, 309-2 on the basis of a corresponding one of the control signal groups 311-*k*, and thereby outputs an output voltage 312-*j* (a gray-scale voltage) in appropriate timing (for example, with one horizontal scanning period). Reference numeral 313 denotes an output switch group composed of six output switches each associated with one of output terminals of the data line driving circuit 116-1, and reference numeral 314 denotes a control signal that determines an ON or OFF state of the output switch group 313. The input-enabling signal 117-2 to the data line driving circuit 116-2 shown in FIG. 1 is output from the data line driving circuit 116-1 shown in FIG. 3 based on the input-enabling signal 117-1. On the other hand, an input-enabling signal from the data line driving circuit 116-2 is meaningless because there is no data line driving circuit serving as a slave to the data line driving circuit 116-2.

Figure 4:
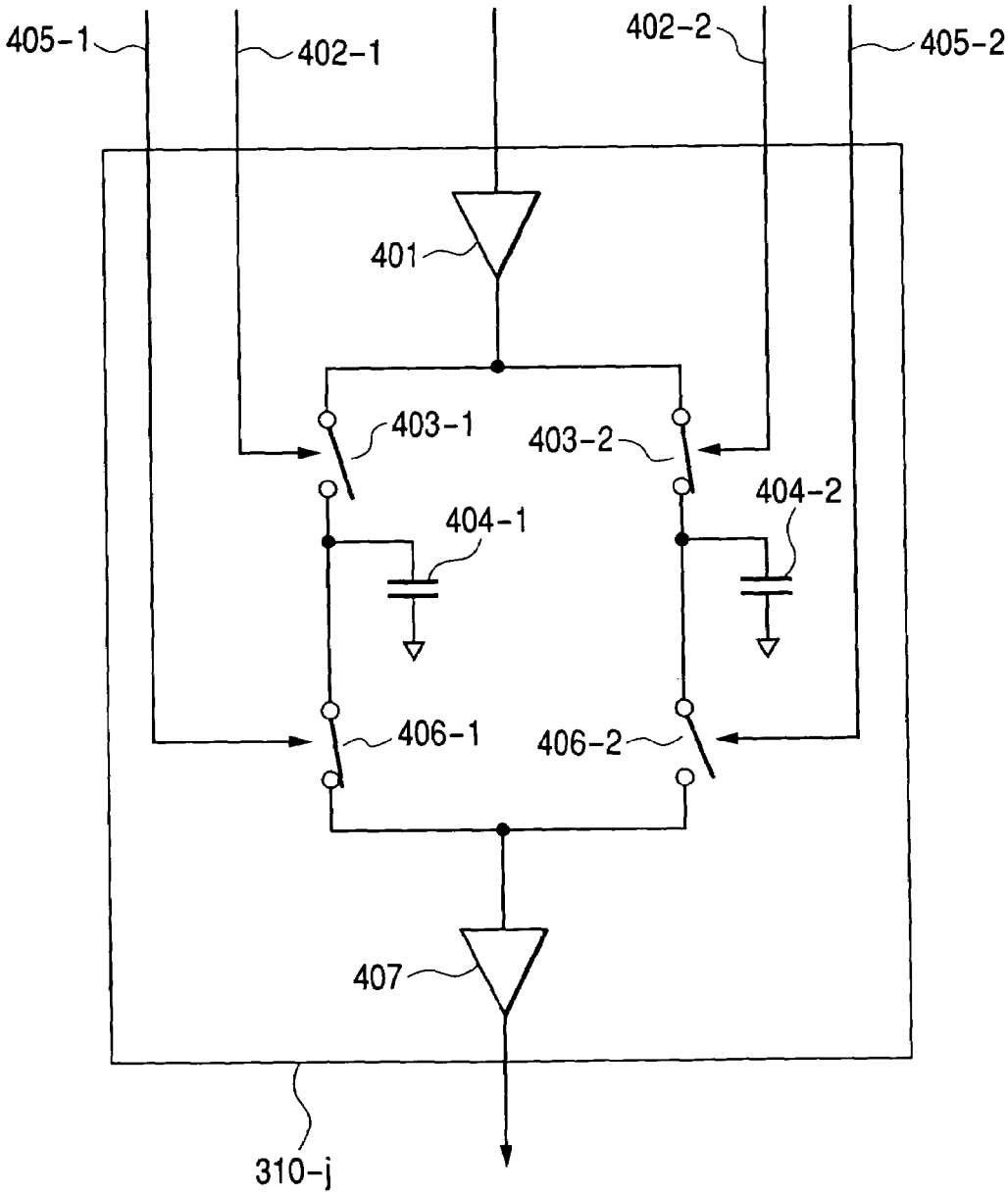
FIG. 4 is a diagram showing a configuration of a sample-and-hold circuit 310-*j;*

FIG. 4 is a diagram showing a configuration of the sample-and-hold circuits 310-*j* (j=1 to 6), and the sample-and-hold circuits 310-1 to 310-6 shown in FIG. 3 each have a function identical to that shown in FIG. 4. Reference numeral 401 denotes a buffer amplifier, reference numerals 402-1 and 402-2 are sampling signals, reference numerals 403-1 and 403-2 are switch circuits that turn on or off in accordance with the sampling signals 402-1, 402-2, reference numerals 404-1 and 404-2 are holding capacitances, reference numerals 405-1 and 405-2 are hold signals, reference numerals 406-1 and 406-2 are switch circuits that turn on or off in accordance with the hold signals 405-1, 405-2, and reference numeral 407 is an output buffer. Here, the sampling signals 402-1, 402-2 and the hold signals 405-1, 405-2 are components of each of the control signal groups 311-*j*.

Figure 5:
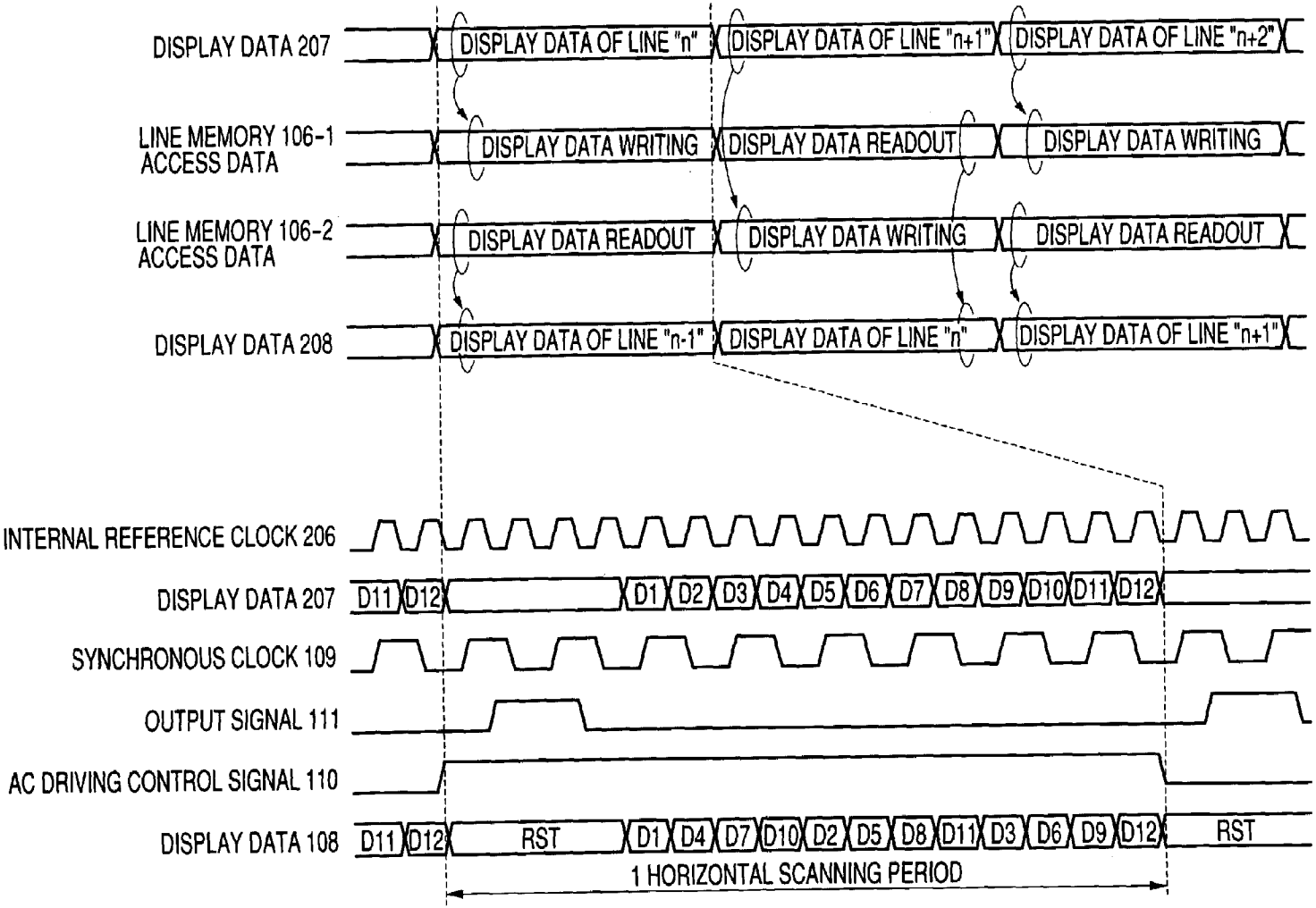
FIG. 5 is a timing chart showing operation of the timing control circuit 104.
Figure 6:
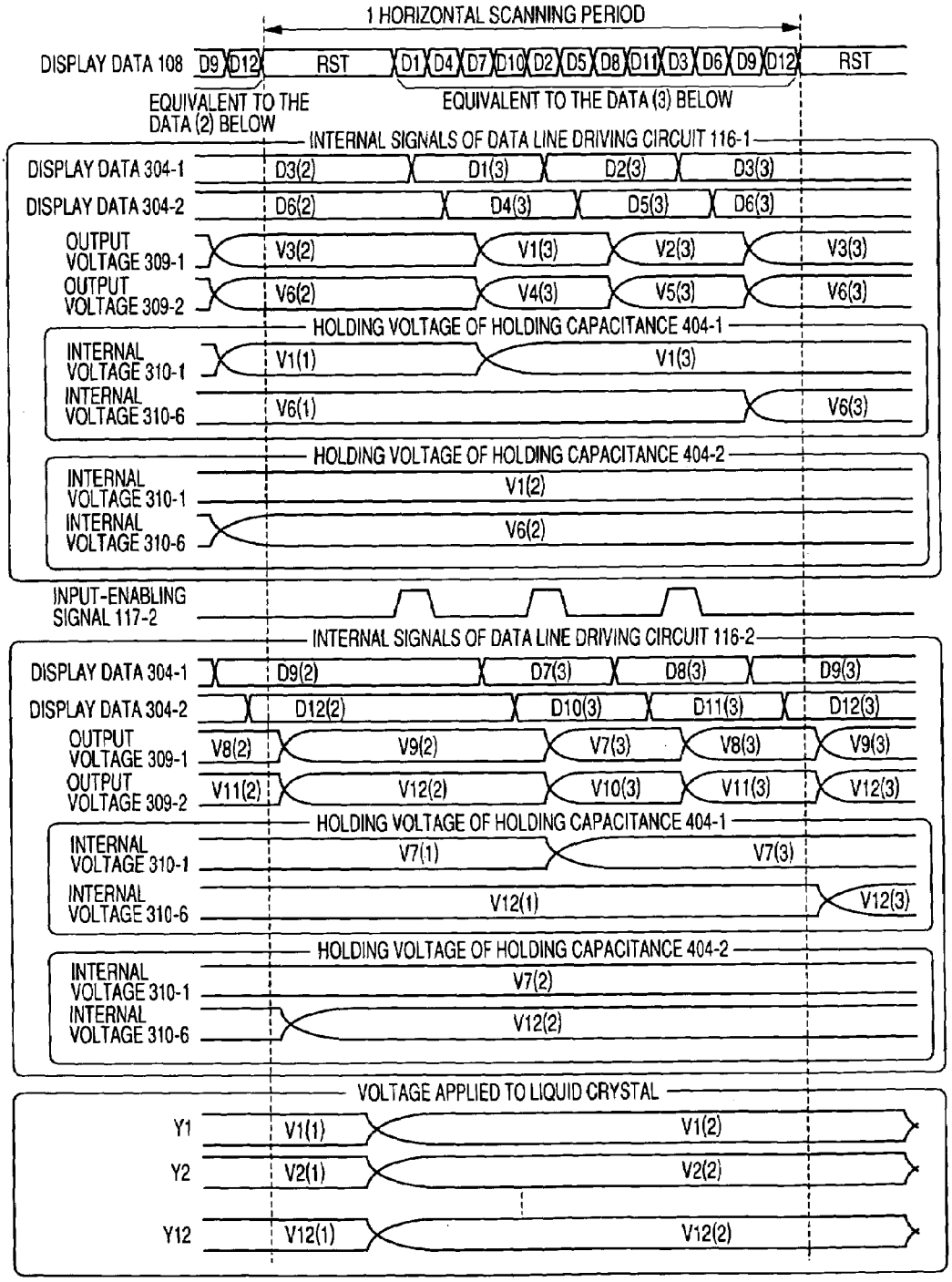
FIG. 6 is a timing chart showing operation of data line driving circuits 116-1, 116-2.

FIG. 5 is a timing chart showing the operation of the timing control circuit 104, and FIG. 6 is a timing chart showing the operation of the data line driving circuits 116-1, 116-2.

The operation of each of the circuits will be explained below by reference to FIGS. 1(A) to 6.

As shown in FIGS. 1(A) and 1(B), the liquid crystal display panel 101 in the present embodiment has a 12×3 pixel matrix structure, and sequentially transferred to the liquid crystal display panel 101 in the order of D1, D2, . . . , D12 are display data 102 associated with 12 pixels in one pixel row corresponding to data lines Y1, Y2, . . ., Y12 of the liquid crystal display panel 101. These input display data 102 are rearranged into the order of D1, D4, D7, D10, D2, D5, D8, D11, D3, D6, D9, and D12 as shown in FIG. 1(B) by using line memories 106-1, 106-2 in the timing control circuit 104, and then they are output as the display data 108.

This operation will be explained in further detail below using FIGS. 2 and 5. When the input signal (the display data 102) input to the timing control circuit 104 from the external system 100 (see FIG. 1) are 8-bit data, they are converted into 10-bit-per-pixel display data 207 so as to comply with characteristics of the liquid crystal display panel 101 by interpolation and expansion of the 8-bit data using the look-up table 203. When the input signal (the display data 102) is 10-bit data, they are directly transferred to the line memories 106-1, 106-2 without being passed through the look-up table 203. When some corrections such as γ correction are to be made, the 10-bit display data may be converted into modified 10-bit display data. Whether the number of bits representing each input signal is 8 or 10 may be judged by the bit-number selectors 202-1, 202-2, or may be judged by the external system 100 so that it controls the bit-number selectors 202-1, 202-2. Gamma correction refers to adjusting of amplitudes and gradients that define γ (gamma) characteristics (gray-scale level versus drive voltage characteristics).

The thus-obtained display data 207 are written into either one of the line memories 106-1, 106-2 based on the memory control signals 205-1, 205-2 generated in the timing regulator 201 on the basis of the control signal 103. At the same time, display data are read out as the display data 208 from the other line memory into which the data 207 are not being written. The write and read operations at this time are performed on the display data corresponding to one horizontal scanning period as a unit, as shown in FIG. 5. For example, while display data associated with one given horizontal pixel row are being written into the line memory 106-1 in the order of the display data D1, D2, D3, . . . , D10, D11, and D12, successively, display data associated with another horizontal pixel row preceding the one given horizontal pixel are read out from the other line memory 106-2 in the order of D1, D4, D7, D10, D2, D5, D8, D11, D3, D6, D9 and D12, as explained above. During the next horizontal scanning period, data is written into the line memory 106-2 from which the display data have been read out during the previous horizontal scanning period, in the order of D1, D2, D3, . . . , D12, and the display data are read out from the line memory 106-1 into which the corresponding display data have been written during the previous horizontal scanning period, in the order of D1, D4, D7, D10, D2, D5, D8, D11, D3, D6, D9 and D12, as in the case of reading out from the line memory 106-2.

As shown in FIG. 5, the display data timing regulator 211 establishes a reset signal RST in a portion of the read-out display data 208 corresponding to the crosshatched invalid display region of the display data 207. The reset signal RST has a specific pattern, and when the data line driving circuit 116-1, 116-2 detect this reset signal pattern after the output signal 111 (see FIG. 1(A)) has risen to a high level, they reset their internal circuit.

At the same time, the data line driving circuit timing regulator 212 (see FIG. 2) generates the sync clock 109 synchronized with display data which serves as a control signal for the data line driving circuits 116-1, 116-2, the ac driving control signal 110 which determines a positive or negative polarity of gray-scale voltages with respect to the liquid crystal display panel 101, and the output signal 111 which determines output timing of the gray-scale voltages output to the liquid crystal display panel 101. The scan line driving circuit timing regulator 213 generates the scan line driving circuit control signal 107 for controlling the scan line driving circuit 115. The PLL circuit 209 is provided to reduce the number of display data buses by multiplying the internal reference clock 206 in steps and also to realize high-speed transfer of the display data and the sync clock. Of course, however, this circuit can be omitted. The thus-generated display data 108 containing the reset signal RST, sync clock 109, the ac driving control signal 110, and the output signal 111 are transferred to the data line driving circuits 116-1, 116-2 via a bus structure of the multi-drop type. At the same time, the scan line driving circuit control signal 107 is transferred to the scan line driving circuit 115. The operation of the scan line driving circuit 115 is the same as that explained for the conventional examples, and is not detailed here.

The operation of the data line driving circuits 116-1, 116-2 based on the display data rearranged in the manner explained above, will be explained below using FIGS. 3, 4 and 6.

Both the data line driving circuits 116-1, 116-2 have an identical circuit configuration, and start to take in display data, based on the display data 108, the sync clock 109, the output signal 111, and the input-enabling signals 117-1, 117-2. More specifically, when the data line driving circuits 116-1, 116-2 detect the RST signal in the display data 108 in a state where the output signal 111 has changed to a high level, they reset the timing regulator 118 (FIG. 3), and then start to count sync clocks by using an internal counter for counting sync clocks. Here, the data line driving circuit 116-1 operates as a master data line driving circuit since the input-enabling signal 117-1 is always at the high level. Accordingly, the data line driving circuit 116-1 generates first latch signals 302-1, 302-2 based on the count of the above-mentioned counter in order to start taking-in of display data after the predetermined number of clocks after the detection of the RST signal. Meanwhile, the data line driving circuit 116-2 does not generate a latch signal at this stage since this driving circuit operates as a slave to the data line driving circuit 116-1 via the input-enabling signal 117-2.

The first latch signals 302-1 and 302-2 are out of phase with each other by a phase angle equivalent to one display data corresponding to one pixel. The first latch circuit 301-1 in the data line driving circuit 116-1 latches the display data D1 on the basis of the first latch signal 302-1, and at the clock signal the other first latch circuit 301-2 latches the display data D4 on the basis of the other first latch signal 302-2. The display data D1 and D4 are latched together with the ac driving control signal 303 for determining the polarity of the gray-scale voltages, and thus generated are display data 304-1 and display data 304-2 each composed of 11 bits, 10 bits for the display data and 1 bit for the ac driving control signal. Incidentally, since the ac driving control signal 303 is usually constant during at least one horizontal scanning period, this signal can be used at any time for determining of gray-scale voltages.

At the same time, the timing regulator 118 in the data line driving circuit 116-1 generates the input-enabling signal 117-2 on the basis of the count by the counter. The input-enabling signal 117-2 is a signal directing the data line driving circuit 116-2 to start taking-in of display data.

In the present embodiment, the data line driving circuit 116 is provided with the two conversion blocks 121-1, 121-2 for two pixels, and therefore takes in display data associated with two pixels for each of the input-enabling signals 171. Therefore, as shown in FIG. 6, the input-enabling signals 171-2 of the high level is output to the data line driving circuit 116-2 before D7 is transferred to the data line driving circuit 116-2, which is the first display data to the data line driving circuit 116-2 during one horizontal scanning period. The data line driving circuit 116-2 takes the display data D7, D10 into its first latch circuits 301-1, 301-2, respectively, based on the input-enabling signal 117-2, as in the case of the data line driving circuit 116-1.

The D1, D4 and D7, D10 that have thus been taken into the data line driving circuits 116-1 and 116-2, respectively, are latched into the second latch circuits 305-1, 305-2 on the basis of the second latch signal 306, and thereby 11-bit display data 307-1, 307-2 are provided.

The gray-scale reference voltage 114 composed of 18 levels is divided by the voltage divider 119 to provide a gray-scale voltage 120 composed of 2048 levels (1024 voltage levels of positive polarity, and 1024 voltage levels of negative polarity).

The thus-obtained gray-scale voltage 120 is input into the D/A converters 308-1, 308-2. The D/A converters 308-1, 308-2 then select one voltage level from among the 2048 gray-scale voltage levels on the basis of the 11-bit display data 307-1 and 307-2, respectively, and provide output voltages 309-1, 309-2, respectively. With the above operation, the digital display data D1, D4, D7 and D10 are converted into analog voltages, which in turn are generated as the output voltages 309-1, 309-2 of both the data line driving circuits 116-1 and 116-2.

Thereafter, the display data are supplied in the order of D2, D5, D8, and D11, and they are taken into the respective circuits which operate sequentially with the count of the internal counters of the timing regulator 118. As in the case of the display data, D1 and D4, and D7 and D10, the display data, D2 and D5, and D8 and D11, are taken into the data line driving circuits 116-1, 116-2, respectively. That is to say, if the display data D1 and D4 are to be taken into the data line driving circuit 116-1 at counts of 1 and 2, respectively, by its internal counter, then the display data D2 and D5 are taken into the data line driving circuit 116-1 at counts of 5 and 6, respectively, by its internal counter, and the output voltages 309-1, 309-2 are generated by the D/A converters 308-1, 308-2. Meanwhile, the data line driving circuit 116-2 takes in the display data D8 and D11 on the basis of the input-enabling signal 117-2, and convert them into the output voltages. The succeedingly incoming display data D3, D6, D9 and D12 are processed in the same way. Therefore, in the data line driving circuit 116-1 during one horizontal scanning period, the output voltages 309-1 are based on the display data D1, D2, D3, respectively, and the output voltages 309-2 are based on the display data D4, D5, D6, respectively. Furthermore, in the data line driving circuit 116-2 during the horizontal scanning period, the output voltages 309-1 are based on the display data D7, D8, D9, respectively, and the output voltages 309-2 are based on the display data D10, D11, D12, respectively. Hereinafter, as shown in FIG. 6, voltage levels based on display data Dx (x=1 to 12), are denoted by Vx (x=1 to 12).

The thus-generated output voltages Vx are each held at respective voltage levels in the sample-and-hold circuits 310-*j*. In the following their operation will be explained. The output voltage Vx input to each sample-and-hold circuit 310-*j* is written into either one of the holding capacitances 404-1, 404-2 via the switch circuit 403-1 or 403-2 on the basis of the sampling signal 402-1 or sampling signal 402-2 shown in FIG. 4. The output voltages Vx are written into the holding capacitances 404-1 and 404-2 alternately for each horizontal scanning period, during a repetition period equal to two horizontal scanning periods, as shown in FIG. 6.

In FIG. 6, the display data Dx and voltages Vx are followed by numerals in parentheses to indicate which horizontal scanning period they are associated with. For example, during a scanning period denoted by (3) in FIG. 6, in the data line driving circuit 116-1, the output voltages V1(3) and V4(3) which have been first converted into analog voltages are written into the holding capacitances 404-1 of the sample-and-hold circuits 310-1 and 310-4, respectively. Next, before the voltage levels of the output voltages 309-1 and 309-2 change from V1(3), V4(3) to V2(3), V5(3), respectively, the switch circuit 403-1 is opened to switch from the write operation to a hold operation. When the voltage levels of the output voltages 309-1 and 309-2 have changed to V2(3), V5(3), respectively, the switch circuits 403-1 in the sample-and-hold circuits 310-2 and 310-5 are changed from the open state to a closed state, and V2(3), V5(3) are written into the corresponding ones of the holding capacitances 404-1. The same operation is also performed when the voltage levels of the output voltages 309-1 and 309-2 have changed from V2(3), V5(3) to V3(3), V6(3), respectively. With the above operation, the output voltages V1(3) to V6(3) are written and held in the holding capacitances 404-1 of the sample-and-hold circuits 310-1 to 310-6. During the next horizontal scanning period, output voltages V1(4) to V6(4) are written and held in the holding capacitances 404-2 of the sample-and-hold circuits 310-1 to 310-6, respectively.

After all the holding capacitances 404-1 of the data line driving circuits 116-1, 116-2 have been written into by completion of transfer of the entire display data associated with one pixel row, the held voltage levels are read out by closing the switch circuits 406-1 in all the sample-and-hold circuits 310-*j* simultaneously with the switch circuits 403-1 open, are current-amplified by the output buffers 407, and are output to the liquid crystal display panel 101 by closing the output switches 313 based on the state of the control signal 314 determined on the basis of the output signal 111. The liquid crystal display panel 101 produces a display by reproducing gray-scale levels on the basis of the voltages output from the data line driving circuits 116-1, 116-2 in each scanning period.

Conventional data line driving circuits required each of the first latch circuits, the second latch circuits, and the D/A converter circuits equal in number to the number of their output terminals (twelve in the above embodiment), but the present embodiment needs only two of each, and consequently can reduce the scale of the circuits greatly. Although the present embodiment needs the sample-and-hold circuits equal in number to the number of the output terminals, the sample-and-hold circuits are circuits for holding analog data, and consequently, the present embodiment is capable of reducing the overall chip size when the number of bits representing display data is increased.

Furthermore, in the present embodiment of the present invention, plural data line driving circuits are regarded as one circuit, and display data are not transferred to data line driving circuits respectively, but they are transferred to conversion blocks, respectively. More specifically, D1 is input to the conversion block 121-1 and then D4 is input to the conversion block 121-2. Likewise, D2 is input to the conversion block 121-1, then D5 is input to the conversion block 121-2. Thereafter, D3 is input to the conversion block 121-1, and then D6 is input to the conversion block 121-2. Thus, the bus structure involving to the data line driving circuits can be made into the multi-drop type similar to a conventional one, and conventional resources can be utilized for the design of the substrate of the data line driving circuits. Furthermore, since the display data bus and the sync clock bus can be designed using the same bus type, it is possible to ignore any effects of delays in transfer of display data for each chip and of a sync clock, and hence to realize the faster transfer of display data.

The number of conversion blocks in one data line driving circuit is determined by a period of time during which the sample-and-hold circuit samples output voltages, and if the period of time required for one sampling operation can be lengthened, the number of conversion blocks 121 each including a D/A converter circuit can be correspondingly reduced. As explained in the present embodiment, by transferring data to each conversion block 121, not to each chip as in the conventional technique, a sufficiently long sample-and-hold period can be secured and this make possible reduction in the chip size of the data line driving circuits. It suffices to secure a sampling period of about one microsecond.

The following explains a case in which the present embodiment is applied to an actual liquid crystal display panel 101. Consider a liquid crystal display panel 101 suitable for a wide-display TV liquid crystal display, for example, and having a resolution capability of 1,366×3 (three colors of red, green and blue)×768 pixels. Ten data line driving circuits each provided with 414 outputs are employed, and a data bus structure is employed which is of the multi-drop type dividing its display bus and sync bus into the left and right halves with a horizontal scanning period of 20 microseconds. When 36 conversion blocks are employed in each of the data line driving circuits, the number of output terminals associated with each of the conversion blocks is 11 or 12, and consequently, 1.6 (=20÷12) microseconds are secured for the sampling period. Similarly, in a case where 10 data line driving circuits each provided with 384 outputs are employed in a liquid crystal display panel having a resolution capability of 1,280×3 (three colors of red, green and blue)×768 pixels, a data bus structure of the multi-drop type comprised of the left and right halves is employed, even if 32 conversion blocks are employed in each of the data line driving circuits, the sample-and-hold period becomes 1.6 microseconds. In both the above two cases, sufficient sample-and-hold period can be secured.

The following explains an embodiment providing a display apparatus capable of obtaining higher image quality by modifying gray-scale reference voltages in addition to the features explained in connection with the first embodiment above, by reference to FIGS. 7(A) to 9.

Figure 7A:
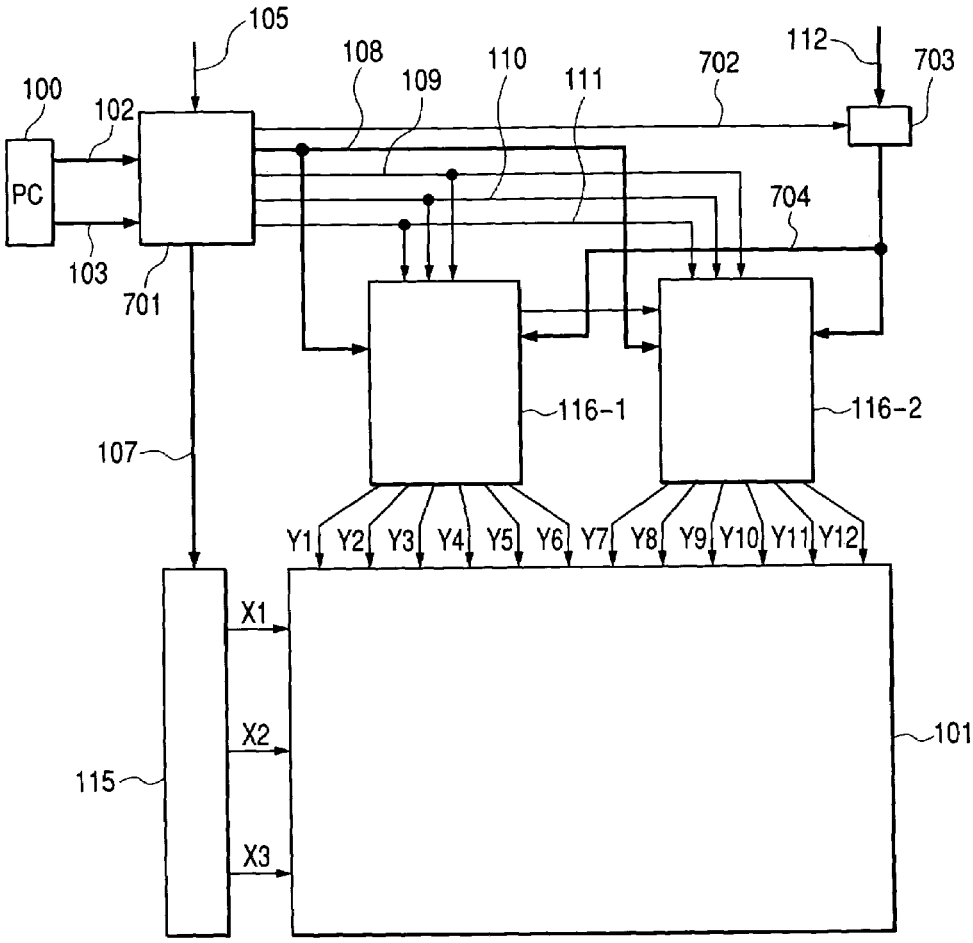
FIGS. 7(A) and 7(B) are diagrams showing a second embodiment of the present invention.

FIG. 7(A) is a diagram showing a circuit configuration of a second embodiment, and the present embodiment, compared with the embodiment of FIG. 1(A), differs in sections denoted as 701 to 703. Consider a case where display data is composed of 10 bits per pixel as in the case of the first embodiment, one picture dot is comprised of three pixels of red (R), green (G) and blue (B) in the liquid crystal display panel 101, column electrodes Y1, Y4, Y7 and Y10 are associated with a display color of red (R), column electrodes Y2, Y5, Y8 and Y11 are associated with a display color of green (G), and column electrodes Y3, Y6, Y9 and Y12 are associated with a display color of blue (B). Reference numeral 701 denotes a timing control circuit, reference numeral 702 is a gray-scale reference voltage generator control signal (hereinafter also called a gray-scale reference voltage control signal), reference numeral 703 is a gray-scale reference voltage generator, and reference numeral 704 is a gray-scale reference voltage.

Figure 7B:
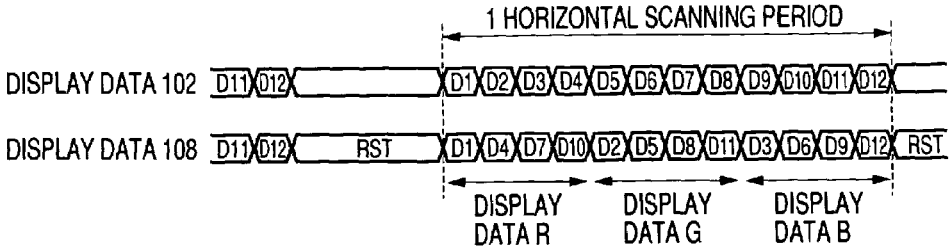

FIG. 7(B) shows the order of transfer of display data 102 and display data 108, which result in shows the same as FIG.

1(B). In the present embodiment, however, data associated with display color R is transferred first during one horizontal scanning period, then data associated with display color G, and finally, data associated with display color B is transferred.

Figure 8:
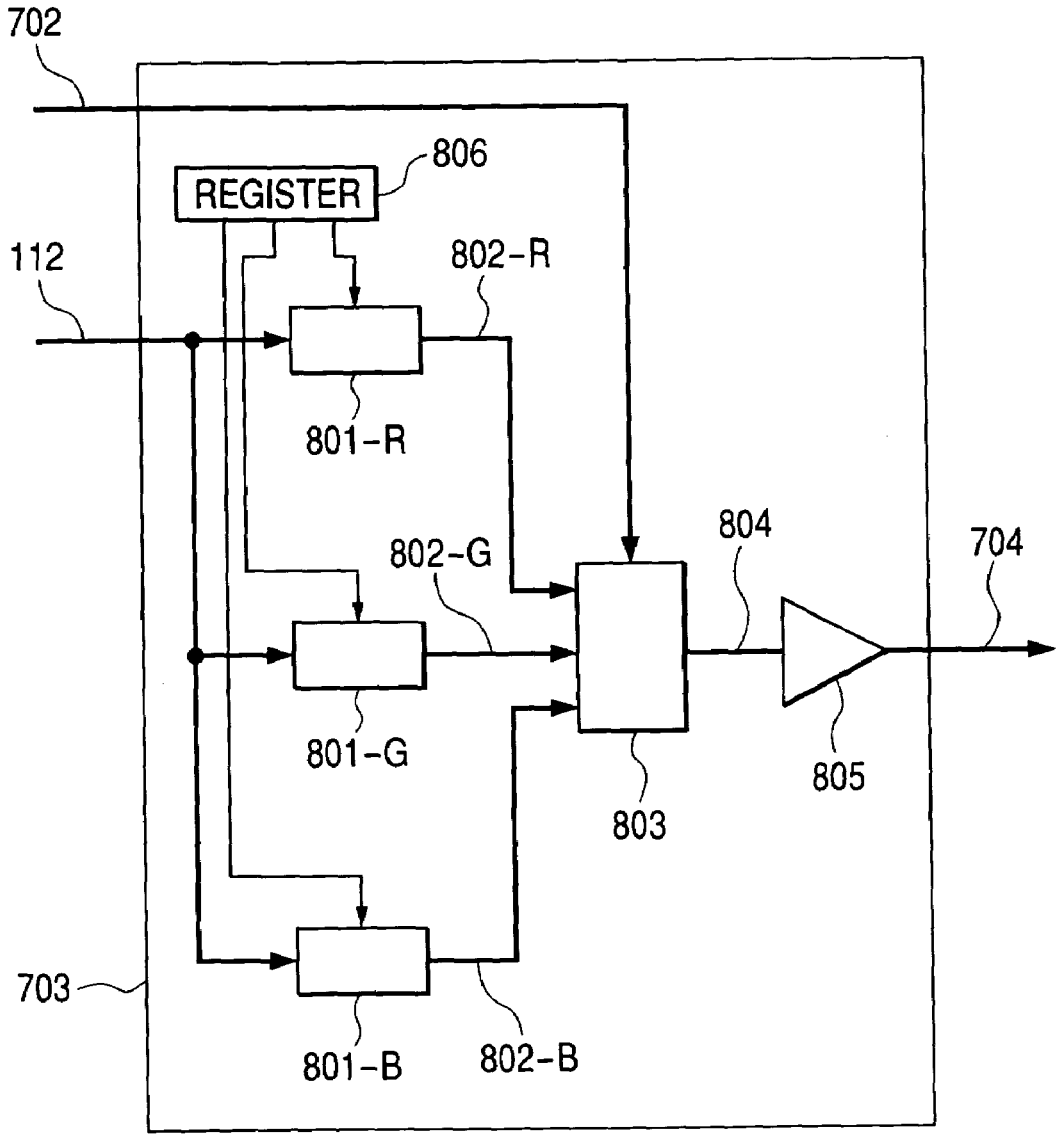
FIG. 8 is a diagram showing a configuration of a gray-scale reference voltage generator 703.
Figure 9:
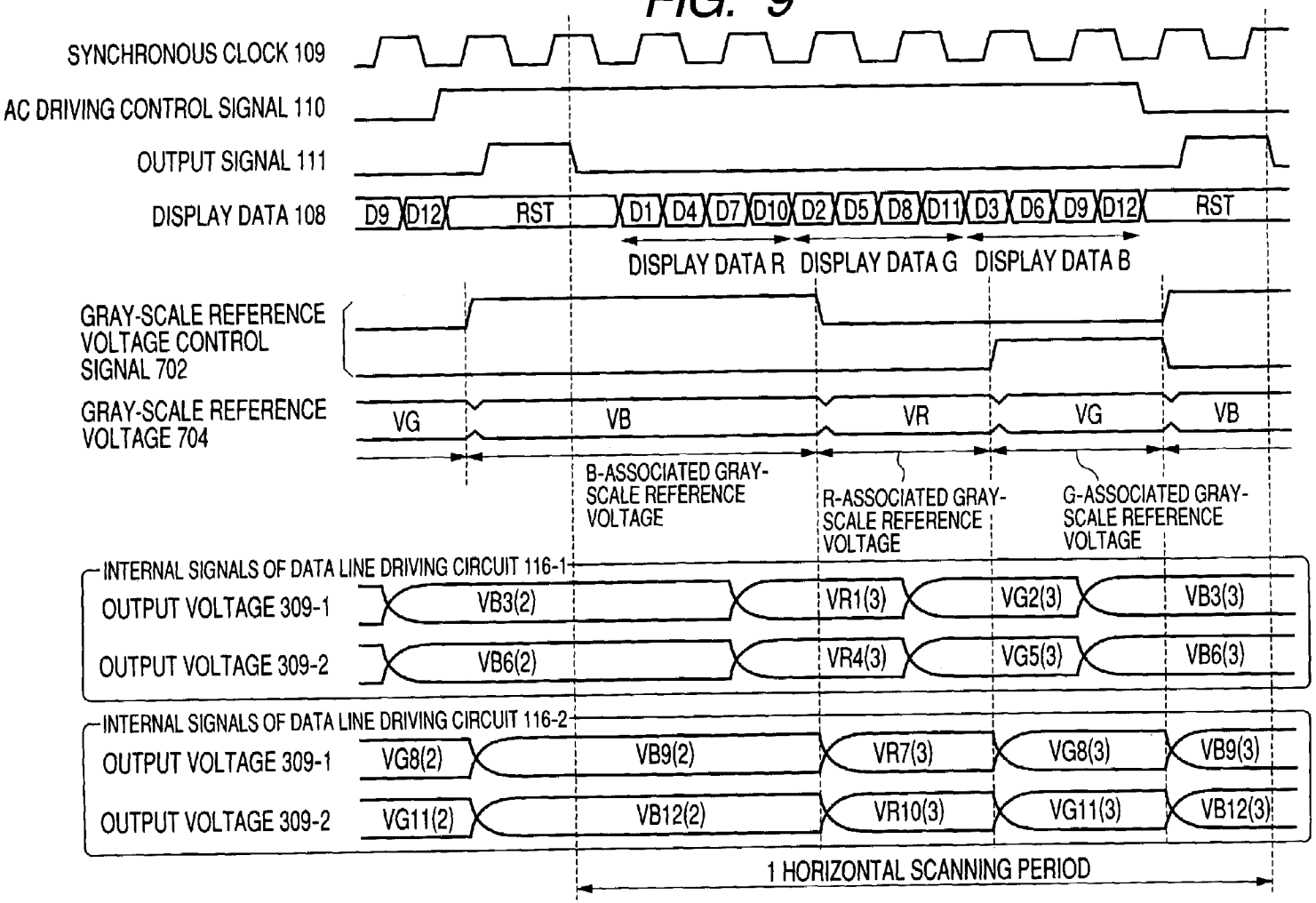
FIG. 9 is a timing chart showing operation of the gray-scale reference voltage generator 703.

FIG. 8 is a diagram showing a configuration of the gray-scale reference voltage generator 703. Reference numerals 801-R, 801-G, 801-B denote voltage dividers for generating gray-scale reference voltages associated with display colors R, G and B, respectively, and reference numerals 802-R, 802-G, 802-B denote gray-scale reference voltages for display color R, G and B, respectively, obtained as a result of voltage division by the associated voltage dividers. Reference numeral 803 denotes a selector for selecting one of the gray-scale reference voltages 802-R, 802-G, 802-B, on the basis of the gray-scale reference voltage generator control signal 702. Reference numeral 804 denotes a selected gray-scale reference voltage, reference numeral 805 is an amplifier for current-amplifying a gray-scale reference voltage, and reference numeral 806 is a register for imparting gamma characteristics to display color R, G and B independently of each other, that is, setting a voltage magnitude for each of gray-scale numbers (levels). FIG. 9 is a timing chart showing the operation of the gray-scale reference voltage generator 703.

The operation of the second embodiment will be explained below by reference to FIGS. 7(A) to 9.

As shown in FIG. 7(A), the timing control circuit 701 in the present embodiment generates the gray-scale reference voltage generator control signal 702 on the basis of the control signal 103, in addition to the signals explained in connection with the first embodiment.

As shown in FIG. 9, the gray-scale reference voltage generator control signal 702 is a two-bit signal used to select among the gray-scale reference voltages 802-R, 802-G and 802-B in the gray-scale reference voltage generator 703. Before the logic of the gray-scale reference voltage generator 703 is explained, the operation of this voltage generator will be explained below.

The gray-scale reference voltage generator 703 includes the circuit elements shown in FIG. 8. The voltage dividers 801-R, 801-G, and 801-B each divide the reference voltage 112, thus generating respectively the gray-scale reference voltages 802-R, 802-G, 802-B each composed of 18 voltage levels. The gray-scale reference voltages 802-R, 802-G, 802-B are gray-scale reference voltages corresponding to the gamma characteristics of the display colors R, G, and B, respectively, of the liquid-crystal display panel 101, and each voltage value is constant.

Here, assume that the voltages 802-R, 802-G, and 802-B each take a value in the order of VR17>VR16, . . . >VR0, VG17>VG16, . . . >VG0, and VB17>VB16, . . . >VB0, respectively. In the selector 803, generated gray-scale reference voltages 802-R, 802-G, 802-B are each selected as the gray-scale reference voltage 804 on the basis of the gray-scale reference voltage generator control signal 702. This selection is made based on the gray-scale reference voltage generator control signal 702. That is, as shown in FIG. 9, when the gray-scale reference voltage generator control signal 702 composed of two bits takes a value of "00", VR17 is selected from among a group consisting of VR17, VG17 and VB17, VR16 is selected from among a group consisting of VR16, VG16, and VB16, . . . , and VR0 is selected from among a group consisting of VR0, VG0 and VB0. When the control signal 702 takes a value of "01", VG17 is selected from among a group consisting of VR17, VG17 and VB17, VG16 is selected from among a group consisting of VR16, VG16 and VB16, . . . , and VG0 is selected from among a group consisting of VR0, VG0 and VB0. When the control signal 702 takes a value of "10", VB17 is selected from among a group consisting of VR17, VG17 and VB17, VB16 is selected from among a group consisting of VR16, VG16 and VB16, . . . , and VB0 is selected from among a group consisting of VR0, VG0, and VB0. The thus-selected gray-scale reference voltage 804 is amplified by the amplifier 805 and then is supplied as the gray-scale reference voltage 704 to the data line driving circuits 116-1, 116-2.

As shown in FIG. 7(B), in the D/A converters 308-1, 308-2 (see FIG. 3) of the data line driving circuits 116-1, 116-2 used in the present embodiment, analog conversion associated with display color R of the liquid-crystal display panel 101 is performed first during one horizontal scanning period, next, conversion associated with display color G is performed, and finally, conversion associated with display color B is performed. During one horizontal scanning period, while output voltages for D1, D4, D7 and D10 associated with display color R are being first written into the sample-and-hold circuits 310-1 and 310-4 (see FIG. 3) of both of the data line driving circuits 116-1, 116-2, the gray-scale reference voltage 704 (see FIG. 8) is selected to be the gray-scale reference voltage 802-R associated with display color R. After completion of writing into the four sample-and-hold circuits 310-1 and 310-4 in all, the gray-scale reference voltage 704 is changed from the gray-scale reference voltage 802-R into the gray-scale reference voltage 802-G associated with display color G. Next, until the writing of output voltages for D2, D5, D8, and D11 associated with display color G into the sample-and-hold circuits 310-2 and 310-5 of the data line driving circuits 116-1, 116-2 is completed, the gray-scale reference voltage 704 is selected to be the gray-scale reference voltage 802-G associated with display color G. After completion of the writing operation, the gray-scale reference voltage 704 is changed from the gray-scale reference voltage 802-G into the gray-scale reference voltage 802-B associated with display color B. Next, until the writing of output voltages corresponding to D3, D6, D9 and D12 associated with display color B into the sample-and-hold circuits 310-3 and 310-6 of the data line driving circuits 116-1, 116-2 is completed, the gray-scale reference voltage 704 is selected to be the gray-scale reference voltage 802-B. After completion of the writing operation, the gray-scale reference voltage 704 is changed from the gray-scale reference voltage 802-B into the gray-scale reference voltage 802-R associated with display color R. The gray-scale reference voltage generator control signal 702 may be generated by the timing control circuit 701 (see FIG. 7(A))in order for such voltage changes to be conducted, and this can be easily realized based on the control signal 103 received.

As explained above, according to the present embodiment, there is no need to provide gray-scale reference voltage input terminals independently for each display color or to provide independent voltage dividers for each display color in the data line driving circuits. Accordingly, it becomes possible to impart gamma characteristics independently to each display color (red, green, and blue) on the basis of gray-scale reference voltages without increasing the chip size of the data line driving circuits.

Figure 10:
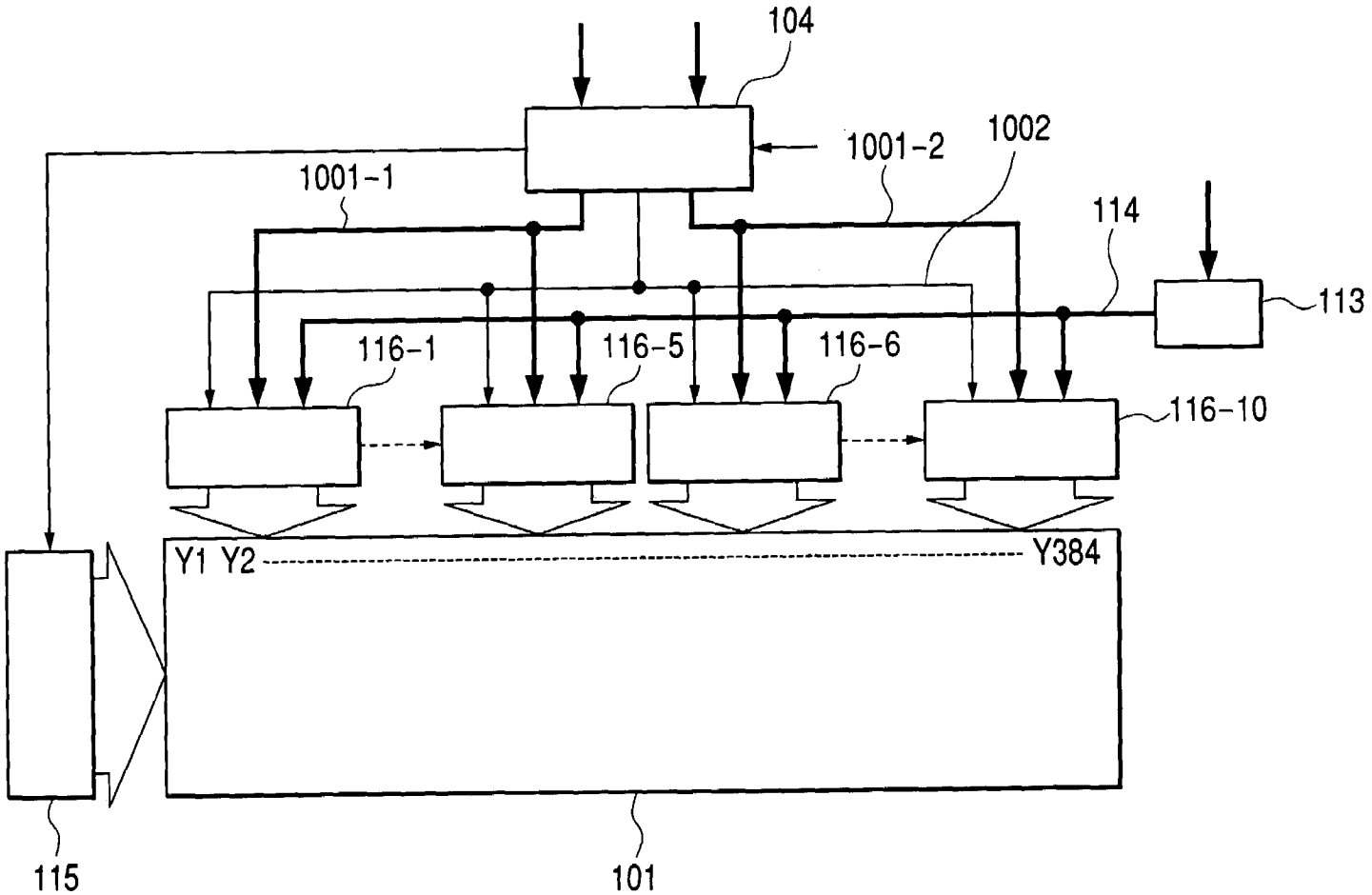
FIG. 10 is a diagram showing a third embodiment of the present invention.
Figure 11:
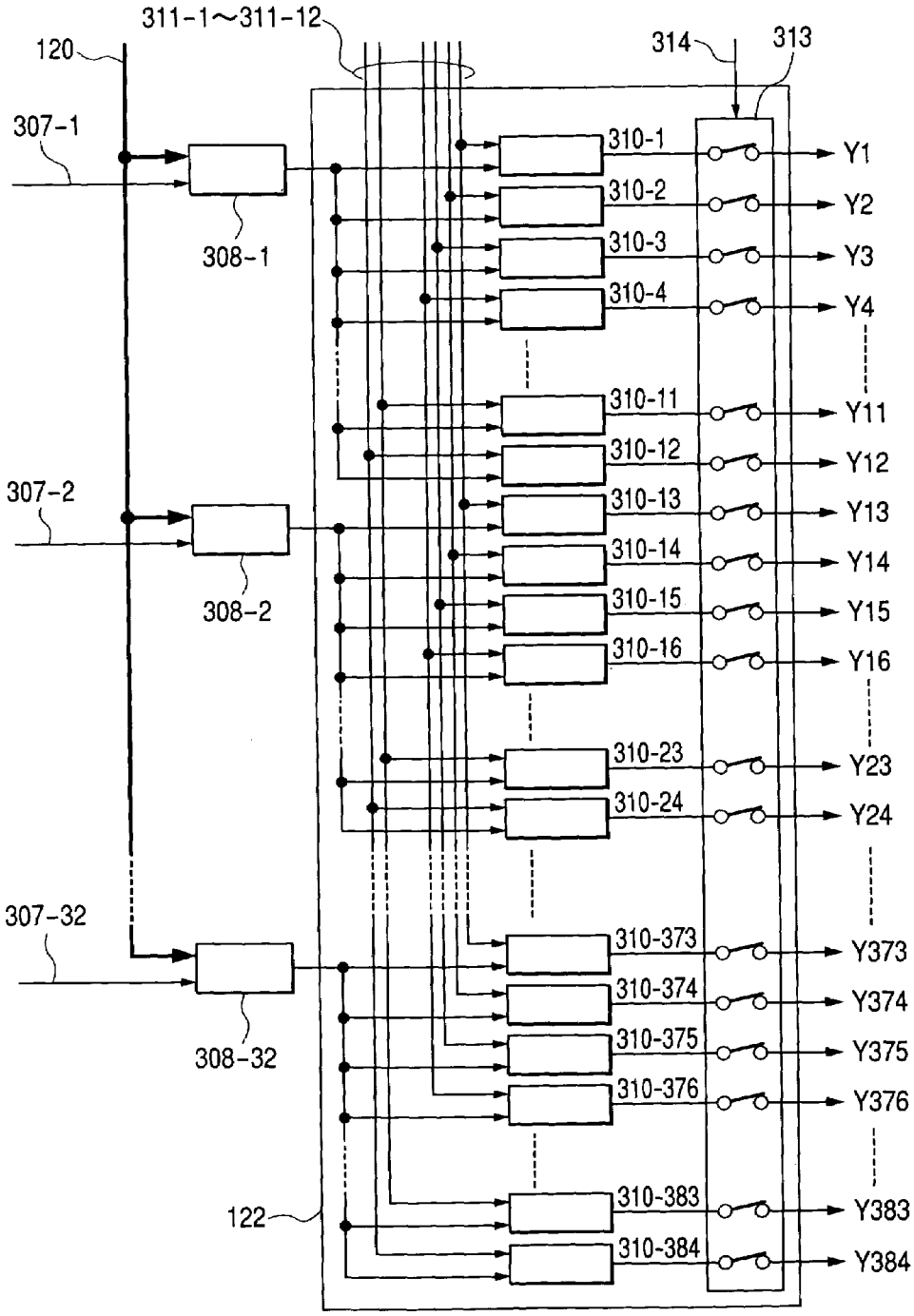
FIG. 11 is a diagram showing a configuration of an output circuit 121.
Figure 12:
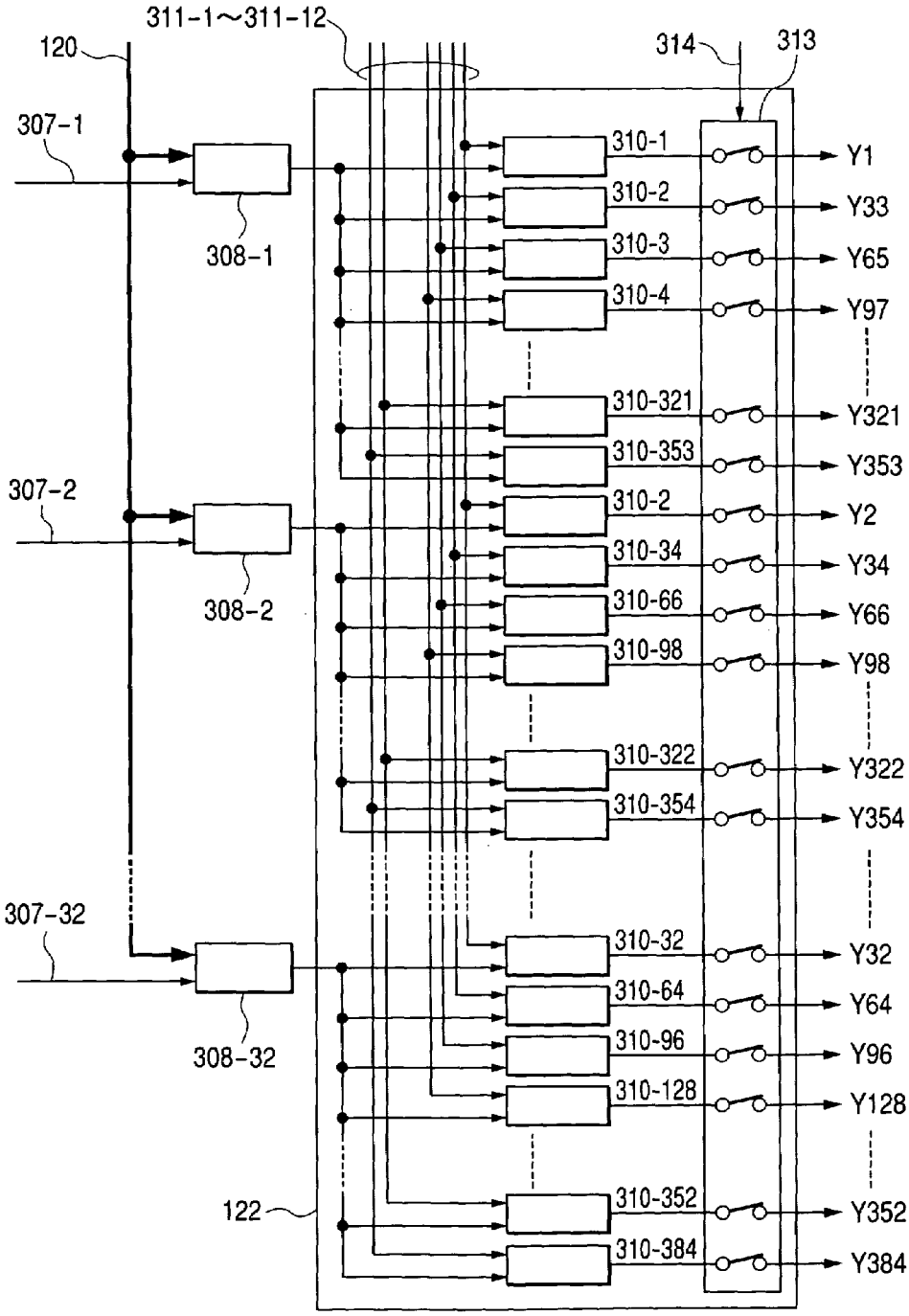
FIG. 12 is a diagram showing a configuration of an output circuit 121 different from the one of FIG. 11.

The following will explain a more specific structure employing a more actual number of outputs from the data line driving circuits, as a third embodiment, by reference to FIGS. 10 to 12. The sections in the present embodiment that functionally overlap those of the first embodiment are not repeated below.

FIG. 10 is a diagram showing a circuit configuration in the third embodiment. In the present embodiment, a horizontal resolution of a liquid crystal display panel 101 is 1280×3 pixels, and its column electrodes are numbered from the left side of the figure in order, Y1, Y2, . . . , Y3840. The number of output terminals per data line driving circuit is selected to be 384. Accordingly, 10 data line driving circuits 116-1 to 116-10 are used, buses for display data sync clock of high transfer rate employ a multi-drop structure comprised of a pair of five on each of the left and right sides, and buses for an ac driving control signal and output signal data of slower transfer rate employ a multi-drop structure for the left and right sides in common.

Reference numeral 1001-1 denotes a display data and sync clock bus associated with five data line driving circuits 116-1 to 116-5 (a first group) shown at the left of FIG. 10, and reference numeral 1001-2 denotes a display data and sync clock bus associated with five data line driving circuits 116-6 to 116-10 (a second group) shown at the right of FIG. 10. Reference numeral 1002 denotes a data bus for an ac driving control signal and output signals.

FIG. 11 is a diagram showing a configuration of an output circuit 122 in the data line driving circuits 116-1 to 116-10 having 384 output terminals in all, and blocks functionally equivalent to those of the data line driving circuits in FIG. 3 are each assigned the same reference numerals.

FIG. 12 is a diagram showing a configuration of an output circuit 122 different from that of FIG. 11. As in the case of FIG. 11, blocks functionally equivalent to those of the data line driving circuits in FIG. 3 are each assigned the same reference numerals.

Figure 13A:
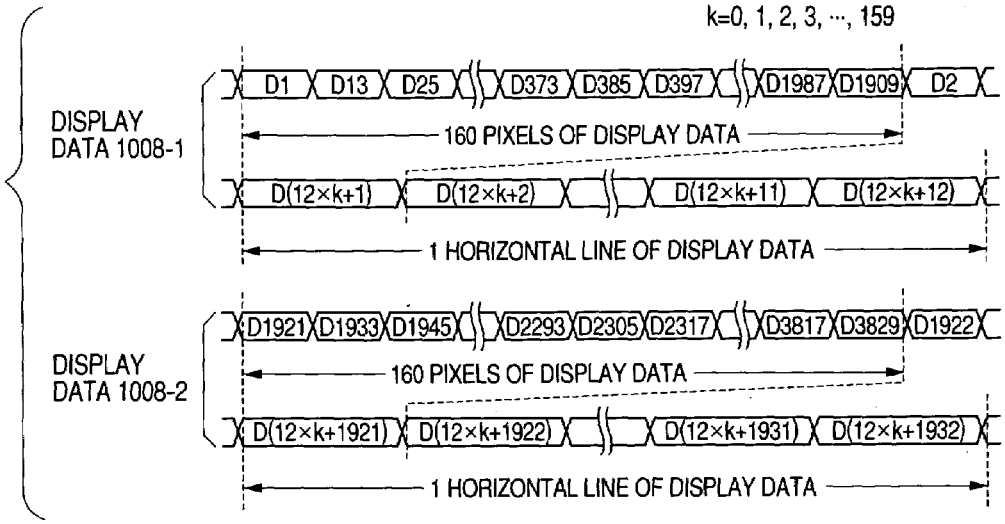
FIGS. 13(A) and 13(B) are diagrams showing transfer timing of display data.
Figure 13B:
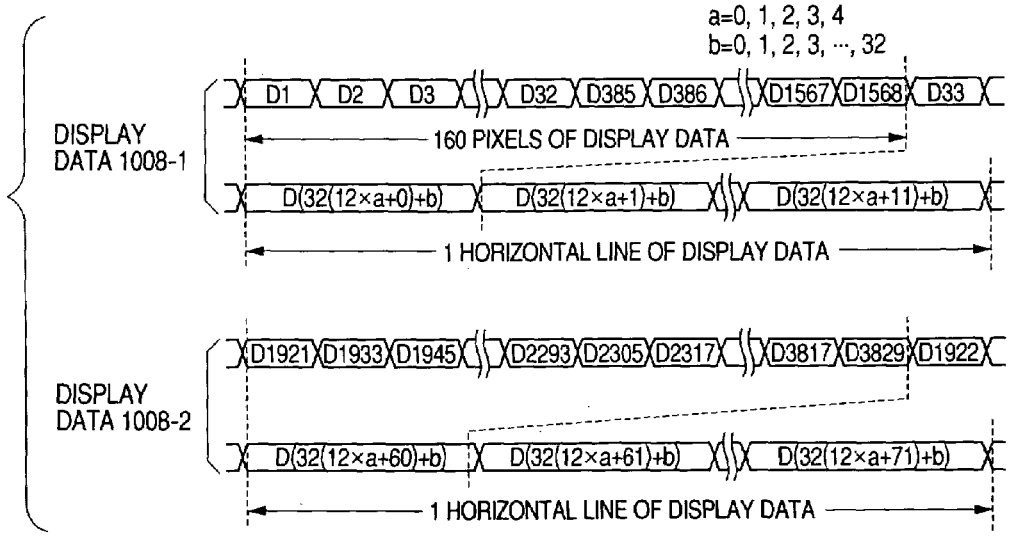

FIG. 13(A) is a timing chart showing an order of transfer of display data 1008-1 and 1008-2 in the output circuit configuration shown in FIG. 11, for the five data line driving circuits at the left and right sides of FIG. 10, respectively. FIG. 13(B) is a timing chart showing the order of transfer of display data 1008-1 and 1008-2 in the output circuit configuration shown in FIG. 12.

The operation of the present embodiment will be explained below by reference to FIGS. 10 to 13(B).

The output circuit 122 shown in FIG. 11 is comprised of 32 D/A converters denoted as 308-1 to 308-32, and 384 sample-and-hold circuits denoted as 310-1 to 310-384. An output terminal of each of the sample-and-hold circuits 310-1 to 310-384 is connected to the liquid crystal display panel via switch circuits 313. More specifically, an output terminal of the sample-and-hold circuit 310-1 is coupled to Y1, and an output terminal of the sample-and-hold circuit 310-2 is coupled to Y2. . . . , and an output terminal of the sample-and-hold circuit 310-84 is coupled to Y384. Since the 32 D/A converters are employed, the present embodiment employs 32 of the first latch circuits and 32 of the second latch circuits which not shown in FIG. 11.

The interconnections between the D/A converters 308-1 to 308-32 and the sample-and-hold circuits 310-1 to 310-384 is such that an output terminal of the D/A converter 308-1 is connected to a group of the sample-and-hold circuits 310-1 to 310-12, and an output terminal of the D/A converter 308-2 is connected to a group of the sample-and-hold circuits 310-13 to 310-24, . . . , an output terminal of the D/A converter 308-32 is connected to a group of the sample-and-hold circuits 310-373 to 310-384.

The control signal group 311-1 is associated with a group of the sample-and-hold circuits 310-1, 310-13, 310-25, . . . , 310-361 and 310-373, and the signal group 311-2 is associated with a group of the sample-and-hold circuits 310-2, 310-14, 310-26, . . . , 310-362 and 310-374. . . . , and the control signal group 311-12 is associated with a group of the sample-and-hold circuits 310-12, 310-24, 310-36, . . . , 310-372 and 310-384. That is to say, each of the control signal group **311-*k* (k=1, 2, 3, . . . , 12) is associated with a group comprised of the sample-and-hold circuits 310-*k*, 310-(k+12), 310-(k+24), . . . , and 310**-(k+372), and all the sample-and-hold circuits in the same group operate at the same time.

As shown in FIG. 13(A), the order of transfer of the display data in this configuration is such that the display data bus 1001-1 connected to the data line driving circuits 116-1 to 116-5 in the left side of the FIG. 10 has transferred thereinto D1, D13, D25, . . . , D1909 in the order named, that is, display data starting with D1, and then display data for every twelfth pixel, during one horizontal scanning period. The number of the D/A converters provided for the five data line driving circuits 116-1 to 116-5 in the left side of the FIG. 10 is 5×32=160. Therefore, when the transfer of the display data corresponding to 160 pixels is completed, the display data transfer returns again to the transfer of display data associated with the data line driving circuit 116-1, and transferred are display data for 160 pixels in the order of D2, D14, D26, . . . , and D1910, that is, display data starting with D2, and then display data for every twelfth pixel. By repeating the above transfer operation twelve times, display data corresponding to 1920 (=60×12) pixels are transferred, and thereby the transfer of the display data is completed which correspond to all the column electrodes assigned to the five data line driving circuits 116-1 to 116-5 at the left side in FIG. 10.

Similarly, initially transferred into the display data bus 1001-2 connected to the data line driving circuits 116-6 to 116-10 at the right side in FIG. 10 are display data starting with D1921, and then display data for every twelfth pixel, that is, display data corresponding to 160 pixels, and then transferred are display data starting with D1921, and then display data for every twelfth pixel, that is, display data corresponding to 160 pixels. By repeating the above transfer operation twelve times, the transfer of the display data is completed which correspond to all the column electrodes assigned to the five data line driving circuits 116-6 to 116-10 at the right side in FIG. 10.

FIG. 12 illustrates the output circuit 122 comprised of 32 D/A converters denoted as 308-1 to 308-32, and 384 sample-and-hold circuits denoted as 310-1 to 310-384. An output terminal of each of the sample-and-hold circuits 310-1 to 310-384 is coupled to the liquid crystal display panel 101 via the switch circuit 313. More specifically, an output terminal of the sample-and-hold circuit 310-1 is coupled to Y1, and an output terminal of the sample-and-hold circuit 310-2 is coupled to Y2, . . . , and an output terminal of the sample-and-hold circuit 310-384 are coupled to Y384.

The interconnections between the D/A converters 308-1 to 308-32 and the sample-and-hold circuits 310-1 to 310-384 is such that an output terminal of the D/A converter 308-1 is connected to a group of the 12 sample-and-hold circuits 310-1, 310-33, 310-65, . . . , and 310-353, and an output terminal of the D/A converter 308-2 is connected to a group of the 12 sample-and-hold circuits 310-2, 310-34, 310-66, . . . , and 310-354, . . . , and an output terminal of the D/A converter 308-32 are connected to a group of the 12 sample-and-hold circuits 310-32, 310-64, 310-96, . . . , and 310-384.

Furthermore, a control signal group 311-1 is associated with a group of the sample-and-hold circuits 310-1, 310-2, 310-3, . . . , and 310-32, and a sample-and-hold circuit control signal group 311-2 is associated with a group of the sample-and-hold circuits 310-33, 310-34, 310-35, . . . , and 310-64, . . . , and a control signal group 311-12 is associated with a group of the sample-and-hold circuits 310-353, 310-354, 310-355, . . . , and 310-384. The sample-and-hold circuits in the same group operate at the same time.

As shown in FIG. 13(B), the order of transfer of the display data during one horizontal scanning period in this configuration is such that the display data bus 1001-1 connected to the data line driving circuits 116-1 to 116-5 in the left side of the FIG. 10 has initially transferred thereinto display data D1 to D32 for 32 pixels which are associated with Y1 to Y32 assigned to the data line driving circuit 116-1, then has transferred thereinto display data D385 to D416 for 32 pixels which are associated with Y1 to Y32 assigned to the data line driving circuit 116-2, next has transferred thereinto display data D769 to D800 for 32 pixels which are associated with Y1 to Y32 assigned to the data line driving circuit 116-3, . . . , and then has transferred thereinto display data D1537 to D1568 for 32 pixels which are associated with Y1 to Y32 assigned to the data line driving circuit 116-5.

After completion of the display data for 160 pixels associated with the data line driving circuits 116-1 to 116-5 in the above-explained way, the display data bus 1001-1 has transferred thereinto again display data D33 to D64 for 32 pixels which are associated with Y33 to Y64 assigned to the data line driving circuit 116-1, then has transferred thereinto display data D417 to D448 for 32 pixels which are associated with Y33 to Y64 assigned to the data line driving circuit 116-2, . . . , and so on. By repeating the operation of display data transfer, the display data for 1920 pixels are transferred.

Similarly, the display data bus 1001-2 connected to the data line driving circuits 116-6 to 116-10 in the right side of the FIG. 10 has transferred thereinto display data for pixels shifted by 1920 pixels in transfer order from corresponding pixels in the case of the display data bus 1001-1 in the left side of FIG. 10.

As explained above, display data are transferred in pattern corresponding to the configurations of interconnections between the D/A converters and the sample-and-hold circuits, and the sample-and-hold circuit control signals, within the data line driving circuits, and thereby display data buses of the multi-drop type are realized in the data line driving circuits employing sample-and-hold circuits.

The embodiments of the present invention are capable of realizing the display data buses of the multi-drop type employing data line driving circuits small in chip area can be realized even when display data are represented by a larger number of bits, by transferring the display data with each of the conversion blocks within the data line driving circuits being treated as a unit. Further, gamma characteristics of colors can be modified using analog voltages independently of each other, by making possible the transfer of one-pixel-row display data for the colors independently of each other, to the respective data line driving circuits.

In an embodiment of the present invention, among display data received in an order of an arrangement of plural pixels in one of pixel rows in a display panel, M (an integer, 1<M< the number of pixels contained in one pixel row) display data for M pixels assigned to each of plural display driving circuits (for example, data line driving circuits) are divided into plural display data sets each comprised of N (an integer, 1≦N<M) display data, and the plural display data sets are rearranged such that one of the plural display data sets assigned to one of the plural display driving circuits is followed by one of the plural display data sets assigned to another of the plural display driving circuits succeeding the one of the plural display driving circuits. Consequently, the circuits (for example, D/A converter circuits and latch circuits) within the display driving circuits can be reduced, and the display driving circuits can be made compact.

In another embodiment of the present invention, among display data received in an order of an arrangement of pixels in one of pixel rows in a display panel, X (an integer, 1<X< the number of pixels assigned to each of the display driving circuits) display data for X pixels assigned to each of the converter circuits within the display driving circuits are divided into plural display data sets each comprised of Y (an integer, 1≦Y<X) display data, and the plural display data sets are rearranged such that one of the plural display data sets assigned to one of the plural converter circuits is followed by one of the plural display data sets assigned to a succeeding one of the plural converter circuits. Consequently, the circuits (for example, D/A converter circuits and latch circuits) within the display driving circuits can be reduced, and the display driving circuits can be made compact.

Further, in yet another embodiment of the present invention, since γ corrections can be made for red, green and blue display signals independently of each other, γ characteristics for red, green and blue display signals can be made to match each other, and consequently, reproduction of images can be improved.

What is claimed is:

1. A display circuit having a display control circuit and a plurality of display driving circuits which apply gray scale voltages to a plurality of pixels in a display panel in accordance with display data, each of said display driving circuit comprising:

an input circuit which receives said display data in digital form from said display control circuit;

at least one converter circuit which converts said display data in digital form into said gray scale voltages in analog form; and an output circuit which outputs said gray scale voltages to said plurality of pixels, wherein said display control circuit receives said display data in an order of an arrangement of corresponding ones of said plurality of pixels in a corresponding one of pixel rows, divides M display data for M pixels of said plurality of pixels in a corresponding one of pixel rows and assigned to each of said plurality of display driving circuits, into a plurality of display data sets each comprised of N display data, rearranges said plurality of display data sets such that one of said plurality of display data sets assigned to one of said plurality of display driving circuits is followed by one of said plurality of display data sets assigned to another of said plurality of display driving circuits succeeding said one of said plurality of display driving circuits, and outputs said rearranged plurality of display data sets to said plurality of display driving circuits, where 1<M< a number of pixels contained in one pixel row, M being an integer, and 1≦N<M, N being an integer.

2. A display circuit according to claim 1, wherein said at least one converter circuit is plural in number, and said input circuit outputs said N display data of each of said plurality of display data sets into said plural converter circuits, respectively and successively.

3. A display circuit which comprises a plurality of display driving circuits which apply gray scale voltages in accordance with display data to corresponding ones of a plurality of pixels in a corresponding one of pixel rows in a display panel simultaneously, and a display control circuit which outputs said display data to said plurality of display driving circuits, wherein said display control circuit receives said display data in an order of an arrangement of corresponding ones of said plurality of pixels in a corresponding one of pixel rows, divides M display data for M pixels of said plurality of pixels in a corresponding one of pixel rows and assigned to each of said plurality of display control circuits, into a plurality of display data sets each comprised of N display data corresponding to N pixels of said M pixels, rearranges said plurality of display data sets such that one of said plurality of display data sets assigned to one of said plurality of display driving circuits is followed by one of said plurality of display data sets assigned to another of said plurality of display driving circuits succeeding said one of said plurality of display driving circuits, and outputs said rearranged plurality of display data sets to said plurality of display driving circuits, where 1<M< a number of pixels contained in one pixel row, M being an integer, and 1≦N<M, N being an integer.

4. A display circuit according to claim 3, wherein one of said plurality of display driving circuits outputs to another of said plurality of display driving circuits an enable signal for said another of said plurality of display driving circuits to start receiving of said display data, at a time when said one of said plurality of display driving circuit has received N display data corresponding to N pixels of said M pixels.

5. A display circuit according to claim 3, wherein each of said plurality of display data sets represents one of red, green and blue signals, and said plurality of display driving circuits convert said N display data in digital form in each of said plurality of display data sets into said gray scale voltages in analog form at one time.

6. A display circuit according to claim 5, further comprising a reference voltage generating circuit, wherein said reference voltage generating circuit generates reference voltages on which said plurality of display driving circuits generate a plurality of gray scale voltages based, for red, green and blue display data, respectively.

7. A display circuit according to claim 6, wherein said display circuit further comprises a register which serves to establish γ characteristics in said reference voltage generating circuit, for red, green and blue gray scale voltages, respectively and separately.

8. A display control circuit which outputs display data to a plurality of display driving circuits which apply gray scale voltages to a plurality of pixels in a display panel in accordance with said display data, wherein each of said plurality of display driving circuits is provided with a plurality of converter circuits which convert said display data in digital form into said gray scale voltages in analog form, and wherein said display control circuit comprises:

an input circuit which receives said display data in an order of an arrangement of corresponding ones of said plurality of pixels in a corresponding one of pixel rows;

a control circuit which divides X display data for X pixels of said plurality of pixels in a corresponding one of pixel rows and assigned to each of said plurality of converter circuits, into a plurality of display data sets each comprised of Y display data, and which rearranges said plurality of display data sets such that one of said plurality of display data sets assigned to one of said plurality of converter circuits is followed by one of said plurality of display data sets assigned to another of said plurality of converter circuits succeeding said one of said plurality of converter circuits; and an output circuit which outputs said rearranged plurality of display data sets to said plurality of display driving circuits, where 1<X< a number of pixels assigned to each of said plurality of display driving circuits, x being an integer, and 1≦Y<X, Y being an integer.

9. A display driving circuit which applies gray scale voltages to a plurality of pixels in a display panel in accordance with said display data, wherein said display driving circuit is provided with an input circuit which receives said display data from a display control circuit, a plurality of converter circuits which convert said display data in digital form into said gray scale voltages in analog form, and an output circuit which applies said gray scale voltages to said plurality of pixels, and wherein said display control circuit divides X display data for X pixels of said plurality of pixels received in an order of an arrangement of corresponding ones of said plurality of pixels in a corresponding one of pixel rows in said display panel and assigned to each of said plurality of converter circuits, into a plurality of display data sets each comprised of Y display data, and rearranges said plurality of display data sets such that one of said plurality of display data sets assigned to one of said plurality of converter circuits is followed by one of said plurality of display data sets assigned to another of said plurality of converter circuits succeeding said one of said plurality of converter circuits, and outputs said rearranged plurality of display data sets to said plurality of display driving circuits, where 1<X< a number of pixels assigned to each of said plurality of display driving circuits, X being an integer, and 1≦Y<X, Y being an integer.

10. A display circuit which comprises a plurality of display driving circuits which apply gray scale voltages in accordance with display data to corresponding ones of a plurality of pixels in a corresponding one of pixel rows in a display panel simultaneously, and a display control circuit which outputs said display data to said plurality of display driving circuits, wherein said display circuit is provided with an adjuster circuit which adjusts γ characteristics for red, green and blue display signals, respectively and separately, and each of said display driving circuits is provided with a gray scale voltage generating circuit which generates a plurality of gray scale voltages based on reference voltages and a converter circuit which selects ones from among said plurality of analog gray scale voltages generated in said gray scale voltage generating circuit, corresponding to said display data, and wherein said converter circuit is used for red, green and blue display data in common, and selects said gray scale voltages in an order of one of red to green to blue, green to blue to red, blue to red to green, and blue to green to red, from among said plurality of analog gray scale voltages generated in said gray scale voltage generating circuit.

11. A display circuit according to claim 10, wherein said adjuster circuit further comprises a reference voltage generating circuit which generates reference voltages for red, green and blue display signals, respectively and separately, and a register which serves to establish γ characteristics in said reference voltage generating circuit, for red, green and blue gray scale voltages, respectively and separately.

12. A display circuit comprising:

a plurality of display driving circuits which applies gray scale voltages to a display panel in accordance with display data;

an input circuit which receives said display data in an order of an arrangement of corresponding ones of said plurality of pixels in a corresponding one of pixel rows in said display panel;

a plurality of converter circuits which converts said display data in digital form into said gray scale voltages in analog form;

a control circuit which divides X display data for X pixels of said plurality of pixels in a corresponding one of pixel rows and assigned to each of said plurality of converter circuits, into a plurality of display data sets each comprised of Y display data, rearranges said plurality of display data sets such that one of said plurality of display data sets assigned to one of said plurality of converter circuits is followed by one of said plurality of display data sets assigned to another of said plurality of converter circuits succeeding said one of said plurality of converter circuits, and outputs said rearranged plurality of display data sets to said plurality of converter circuits; and an output circuit which outputs said gray scale voltages associated with one of said pixel rows, to pixels contained in said one of said pixel rows simultaneously, where $1<X<$ a number of pixels assigned to each of said plurality of display driving circuits, X being an integer, and $1 \leqq Y<X$, Y being an integer.

13. A display control circuit which outputs display data to a plurality of display driving circuits which apply gray scale voltages to a plurality of pixels in a display panel in accordance with said display data, said display control circuit comprising:

an input circuit which receives said display data in an order of an arrangement of corresponding ones of said plurality of pixels in a corresponding one of pixel rows;

a control circuit which divides M display data for M pixels of said plurality of pixels in a corresponding one of pixel rows and assigned to each of said plurality of display driving circuits, into a plurality of display data sets each comprised of N display data, and which rearranges said plurality of display data sets such that one of said plurality of display data sets assigned to one of said plurality of display driving circuits is followed by one of said plurality of display data sets assigned to another of said plurality of display driving circuits succeeding said one of said plurality of display driving circuits; and an output circuit which outputs said rearranged plurality of display data sets to said plurality of display driving circuits, where $1<M<$ a number of pixels contained in one pixel row, M being an integer, and $1 \leqq N<M$, N being an integer.

14. A display control circuit according to claim 13, further comprising a memory capable of storing display data corresponding to said plurality of pixels in at least one pixel row, wherein said display control circuit writes said display data into said memory in said order of the arrangement of corresponding ones of said plurality of pixels in a corresponding one of said pixel rows, and then reads said display data in said rearranged order of said display data from said memory.

15. A display control circuit according to claim 14, wherein said display control circuit further comprises a converter circuit which converts a number of bits representing said display data from said input circuit and outputs said converted display data to said memory.

16. A display control circuit according to claim 13, wherein each of said plurality of display data sets represents one of red, green and blue signals.

17. A display control circuit according to claim 13, wherein said output circuit outputs said display data to said plurality of display driving circuits via a common bus.

18. A display control circuit according to claim 13, wherein said plurality of display driving circuits are divided into a plurality of display driving circuit groups, said control circuit performs said rearranging of said plurality of data sets in each of said plurality of display driving circuit groups independently of another of said plurality of display driving circuit groups, said output circuit outputs said rearranged plurality of display data in said each of said plurality of display driving circuit groups to said each of said plurality of display driving circuit groups in a common bus assigned thereto in parallel with others of said plurality of display driving circuit groups.

19. A display control circuit according to claim 13, wherein said control circuit performs said rearranging of said plurality of data sets in each of said pixel rows.

20. A display control circuit which outputs display data to a plurality of display driving circuits which apply gray scale voltages to a display panel in accordance with said display data, said display control circuit comprising:

an input circuit which receives said display data; and an output circuit which outputs to a first one of said plurality of display driving circuits, display data of a first display data set which are smaller in number than display data of a first display data group which correspond to a first group of gray scale voltages to be applied to said display panel simultaneously by said first one of said plurality of display driving circuits, and then outputs to a second one of said plurality of display driving circuits, display data of a second display data set which are smaller in number than display data of a second display data group which correspond to a second group of gray scale voltages to be applied to said display panel simultaneously by said second one of said plurality of display driving circuits.

21. A display control circuit which outputs display data to a plurality of display driving circuits which apply gray scale voltages associated with one of pixel rows simultaneously to a display panel, in accordance with said display data, said display control circuit comprising:

an input circuit which receives said display data; and an output circuit which divides said display data associated with one of pixel rows and assigned to each of said plurality of display driving circuits into a plurality of display data sets, and outputs said plurality of display data sets at different times to said each of said plurality of display driving circuits, during intervals in which said plurality of display driving circuits apply said gray scale voltages associated with another of said pixel rows preceding said one of said pixel rows simultaneously to said display panel.

22. A display driving circuit which applies gray scale voltages to pixels in a display panel in accordance with display data, said display driving circuit comprising:

an input circuit which receives said display data in digital form;

converter circuits which convert said display data in digital form into said gray scale voltages in analog form;

an output circuit which outputs said gray scale voltages to M pixels assigned to said display driving circuit simultaneously, where 1<M< a number of pixels contained in one pixel row, M being an integer; and an enable-signal output circuit which outputs to another display driving circuit an enable signal for said another display driving circuit to start receiving of said display data at a time when said one display driving circuit has received N display data corresponding to N pixels of said M pixels, where $1 \leqq N < M$, N being an integer.

23. A display driving circuit according to claim 22, wherein said converter circuits convert N display data corresponding to said N pixels simultaneously.

24. A display driving circuit according to claim 22, further comprising a counter circuit which counts clock signals, wherein said input circuit determines said N display data to have been received when a count of said clock signals reaches a predetermined number.

* * * * *